US006296061B1

(12) United States Patent
Leismer

(10) Patent No.: US 6,296,061 B1
(45) Date of Patent: Oct. 2, 2001

(54) PILOT-OPERATED PRESSURE-EQUALIZING MECHANISM FOR SUBSURFACE VALVE

(75) Inventor: Dwayne D. Leismer, Pearland, TX (US)

(73) Assignee: Camco International Inc., Houston, TX (US)

( * ) Notice: Subject to any disclaimer, the term of this patent is extended or adjusted under 35 U.S.C. 154(b) by 0 days.

(21) Appl. No.: 09/458,637

(22) Filed: Dec. 9, 1999

Related U.S. Application Data

(60) Provisional application No. 60/113,327, filed on Dec. 22, 1998.

(51) Int. Cl.[7] ..... E21B 34/10

(52) U.S. Cl. ..... 166/386; 166/375; 166/324; 166/332.7; 166/332.8

(58) Field of Search ..... 166/375, 386, 166/321, 324, 332.7, 332.8

(56) References Cited

U.S. PATENT DOCUMENTS

| | | |
|---|---|---|
| 19,013 | 1/1858 | Carr . |
| 709,262 | 9/1902 | Gold . |
| 1,655,729 | 1/1928 | Jones . |
| 1,783,621 | 12/1930 | Johnson . |

(List continued on next page.)

FOREIGN PATENT DOCUMENTS

| | | |
|---|---|---|
| 2504616 C2 | 5/1984 | (DE) . |
| 2257501 | 11/1975 | (FR) . |
| 1461641 | 1/1977 | (GB) . |
| 1598863 | 9/1981 | (GB) . |
| 2073288 A | 10/1981 | (GB) . |
| 2115461 A | 9/1983 | (GB) . |
| 2217753A | 11/1989 | (GB) . |
| 2292959 B | 9/1994 | (GB) . |
| 296883 | 3/1971 | (SU) . |
| 570698 | 11/1977 | (SU) . |
| 651120 | 3/1979 | (SU) . |
| 933955 | 6/1982 | (SU) . |
| 1063985 A | 12/1983 | (SU) . |
| WO 98/55732 A1 | 12/1998 | (WO) . |
| WO 98/57029 A2 | 12/1998 | (WO) . |

*Primary Examiner*—Thomas B. Will
*Assistant Examiner*—Zakiya Walker
(74) *Attorney, Agent, or Firm*—Goldstein & Healey LLP

(57) ABSTRACT

A subsurface valve with a pressure-equalizing mechanism is provided to permit pressure above and below a valve closure member to equalize prior to the opening of the valve closure member. The pressure-equalizing mechanism may be installed, for example, in the valve closure member or in an annular housing in the subsurface valve. The mechanism includes a pilot activator disposed for reciprocal movement within a pilot bore. A flow tube that is disposed for longitudinal movement with a longitudinal bore of the subsurface valve is used to shift the pilot activator within the pilot bore from a closed or sealed position to an open or equalizing position. In the open position, fluid pressure below the valve closure member is allowed to flow through a pilot passageway that establishes fluid communication between the pilot bore and a cylinder within which a pilot piston is moveably disposed. Exposure of the pilot piston to fluid pressure below the valve member moves the pilot piston within the cylinder, which in turn moves an equalizing plug that is disposed for reciprocal movement within a plug bore from a closed or sealed position to an open or equalizing position. Movement of the equalizing plug to its open or equalizing position establishes fluid communication from below the valve closure member to above the valve closure member through an equalizing passageway. Pressure above and below the valve closure member is equalized through the equalizing passageway prior to the opening of the valve closure member by further downward movement of the flow tube.

70 Claims, 12 Drawing Sheets

U.S. PATENT DOCUMENTS

| | | | |
|---|---|---|---|
| 1,807,970 | 6/1931 | Davis . | |
| 1,998,913 | 4/1935 | Wheaton . | |
| 2,812,821 | 11/1957 | Nelson . | |
| 2,839,082 | 6/1958 | Moore et al. . | |
| 2,879,799 | 3/1959 | Jansen et al. . | |
| 2,943,638 | 7/1960 | Prucha . | |
| 3,075,539 | 1/1963 | Yoder . | |
| 3,078,923 | 2/1963 | Tausch . | |
| 3,196,699 | 7/1965 | Ipsen . | |
| 3,382,895 | 5/1968 | McCullough . | |
| 3,405,730 | 10/1968 | Baumann . | |
| 3,442,484 | 5/1969 | Carr et al. . | |
| 3,485,270 | 12/1969 | Freeman . | |
| 3,631,888 | 1/1972 | Anton et al. . | |
| 3,640,501 | 2/1972 | Walton . | |
| 3,788,595 | 1/1974 | Colonna . | |
| 3,799,204 | 3/1974 | Watkins et al. . | |
| 3,804,124 | 4/1974 | Finke et al. . | |
| 3,865,141 | 2/1975 | Young . | |
| 3,870,079 | 3/1975 | Finke et al. . | |
| 3,961,645 | 6/1976 | Kagan . | |
| 3,971,438 | 7/1976 | Crowe . | |
| 4,009,753 | 3/1977 | McGill et al. . | |
| 4,252,197 | 2/1981 | Pringle . | |
| 4,308,894 | 1/1982 | Carpentier . | |
| 4,362,214 | 12/1982 | Pringle et al. . | |
| 4,373,587 | 2/1983 | Pringle . | |
| 4,411,316 | 10/1983 | Carmody . | |
| 4,415,036 | 11/1983 | Carmody et al. . | |
| 4,427,071 | 1/1984 | Carmody . | |
| 4,452,311 | 6/1984 | Speegle et al. . | |
| 4,457,356 | 7/1984 | Carmody et al. . | |
| 4,475,599 | 10/1984 | Akkerman . | |
| 4,478,286 | 10/1984 | Fineberg . | |
| 4,629,002 | 12/1986 | Pringle . | |
| 4,660,646 | 4/1987 | Blizzard . | |
| 4,703,805 | 11/1987 | Morris . | |
| 4,722,399 | 2/1988 | Pringle . | |
| 4,938,376 | 7/1990 | Fieseler et al. . | |
| 4,976,317 | 12/1990 | Leismer . | |
| 5,058,682 | 10/1991 | Pringle . | |
| 5,172,716 | 12/1992 | Paptzun . | |
| 5,249,600 | 10/1993 | Blume . | |
| 5,259,590 | 11/1993 | Chambers . | |
| 5,310,004 | 5/1994 | Leismer . | |
| 5,503,229 | 4/1996 | Hill, Jr. et al. . | |
| 5,682,921 | 11/1997 | Rawson et al. . | |
| 5,752,569 | 5/1998 | Bhavsar et al. . | |
| 5,884,705 | 3/1999 | Hill, Jr. . | |
| 6,079,497 * | 6/2000 | Johnston et al. | 166/324 |
| B1 4,161,219 | 2/1984 | Pringle . | |

* cited by examiner

PILOT-OPERATED PRESSURE-EQUALIZING MECHANISM FOR SUBSURFACE VALVE

RELATED APPLICATIONS

This application claims the benefit of U.S. Provisional Application No. 60/113,327 filed Dec. 22, 1998.

BACKGROUND OF THE INVENTION

1. Field of the Invention

The present invention relates to a subsurface safety valve used for controlling fluid flow in a well conduit and, more particularly, to an equalizing subsurface safety valve.

2. Description of the Related Art

Subsurface safety valves are commonly used in wells to prevent uncontrolled fluid flow through the well in the event of an emergency, such as to prevent a well blowout. Conventional safety valves use a flapper which is biased by a spring to a normally closed position, but is retained in an open position by the application of hydraulic fluid from the earth's surface. A typical subsurface safety valve is shown and described in U.S. Pat. No. 4,161,219, which is commonly assigned hereto.

When the flapper is in the closed position, well fluid pressure below the flapper acting upon a relatively large surface area of the flapper makes opening of the flapper difficult. This difficulty in opening cannot be easily overcome simply by increasing the force exerted against the flapper by an opening piston and cylinder assembly because the relatively small cross-sectional area of the opening piston and cylinder assembly would require a fluid pressure that may burst the control line carrying hydraulic fluid from the earth's surface to the piston and cylinder assembly, or destroy critical seals therein. Additionally, when the flapper is opened the initial flow of well fluid is relatively rapid which tends to etch, or erode, the primary sealing surface of the flapper. Any damage to this primary sealing surface is extremely critical because it is this sealing surface which must be intact to prevent uncontrolled flow of well fluids and to prevent a possible well blow out. The present invention solves these difficulties by providing a subsurface safety valve with an equalizing mechanism to allow the pressure above and below the flapper to equalize prior to the complete opening of the flapper.

SUMMARY OF THE INVENTION

The present invention is directed generally to a subsurface safety valve with a pressure equalizing mechanism. In one aspect, the invention may be an equalizing subsurface valve for controlling fluid flow in a well conduit, comprising: a body member having a longitudinal bore extending therethrough; a valve closure member mounted within the body member to control fluid flow through the longitudinal bore, and having a first surface and a second surface; a valve actuator disposed within the body member and remotely shiftable to move the valve closure member between open and closed positions; a pilot activator movably disposed within a pilot bore in the valve in response to movement of the valve actuator; a pilot piston movably disposed within a cylinder in the valve, a first surface of the pilot piston being in fluid communication with the pilot bore through a pilot passageway in the valve, the pilot activator alternately permitting and preventing fluid communication between the longitudinal bore adjacent the second surface of the valve closure member and the first surface of the pilot piston through the pilot passageway; and an equalizing plug movably disposed within a plug bore in the valve in response to movement of the pilot piston, the equalizing plug alternately permitting and preventing fluid communication between the longitudinal bore adjacent the second surface of the valve closure member and the longitudinal bore adjacent the first surface of the valve closure member through at least one equalizing passageway in the valve. Another feature of this aspect of the present invention is that the first surface of the pilot piston includes a first active surface area intermittently in fluid communication with fluid pressure in the longitudinal bore adjacent the second surface of the valve closure member through the pilot passageway, and the equalizing plug includes a head portion having a second active surface area in fluid communication with fluid pressure in the longitudinal bore adjacent the second surface of the valve closure member, the first active surface area being greater than the second active surface area. Another feature of this aspect of the present invention is that the valve actuator includes a sleeve member disposed for movement within the longitudinal bore and an operating piston disposed within the body member and remotely shiftable to move the sleeve member within the longitudinal bore. Another feature of this aspect of the present invention is that the operating piston is a rod piston movably disposed within a cylinder in the body member with one side of the operating piston adapted to be in communication with a source of hydraulic fluid for moving the sleeve member within the longitudinal bore. Another feature of this aspect of the present invention is that the operating piston is a hydraulic operating piston that is moveable in response to application of hydraulic fluid and includes an operating piston surface area in communication with the hydraulic fluid; the pilot activator includes a pilot valve seat defined by a first annular sealing surface on the pilot activator and a second annular sealing surface about the pilot bore, the pilot valve seat defining a pilot surface area, the equalizing plug includes a plug valve seat defined by a third annular sealing surface on the equalizing plug and a fourth annular sealing surface within the valve, the plug valve seat defining a plug surface area; the pilot surface area is smaller than the operating piston surface area; and the plug surface area is greater than the operating piston surface area. Another feature of this aspect of the present invention is that the pilot activator includes a distal end extending from the pilot bore into the longitudinal bore above the first surface of the valve closure member when the pilot activator is in a closed position. Another feature of this aspect of the present invention is that the pilot bore, the pilot passageway, the cylinder, and the plug bore are disposed within the valve closure member. Another feature of this aspect of the present invention is that the pilot bore, the pilot passageway, the cylinder, and the plug bore are disposed within an annular housing connected to the valve body. Another feature of this aspect of the present invention is that the valve actuator includes a sleeve member having a first recessed profile and a second recessed profile, a distal end of the pilot activator being disposed within the first recessed profile when the valve closure member is in a fully-open position, against an intermediate portion of the an outer surface of the sleeve member when the pilot activator and equalizing plug are in equalizing positions, and within the second recessed profile when the valve closure member is in a fully-closed position the at least one equalizing passageway is disposed within the annular housing. Another feature of this aspect of the present invention is that the at least one equalizing passageway is disposed within the valve closure member. Another feature of this aspect of the present invention is that the valve closure member further includes an annular tapered surface joining the second surface of the valve closure member and the plug bore, and the at least one equalizing passageway establishes fluid communication between the first surface of the valve closure member and the tapered surface. Another feature of this aspect of the present invention is that the at least one equalizing passageway is an internal fluid passageway through the equalizing plug. Another feature of this aspect of the present invention is that the internal fluid flow passageway includes a generally longitudinal passageway extending from a second end of the equalizing plug and is in fluid communication with at least one generally radially-disposed opening exiting the plug at a location between the second end of the plug and the annular sealing surface of the plug. Another feature of this aspect of the present invention is that the pilot activator includes a first annular sealing surface for cooperable sealing engagement with a second annular sealing surface disposed about the pilot bore. Another feature of this aspect of the present invention is that at least one of the first and second annular sealing surfaces further includes a pliable annular sealing surface. Another feature of this aspect of the present invention is that the equalizing plug includes a third annular sealing surface adjacent a first end thereof for cooperable sealing engagement with a fourth annular sealing surface formed within the valve closure member. Another feature of this aspect of the present invention is that at least one of the third and fourth annular sealing surfaces further includes a pliable annular sealing surface. Another feature of this aspect of the present invention is that the equalizing plug further includes an internal fluid passageway for establishing fluid communication between the longitudinal bore adjacent the first surface of the valve closure member and an annular space formed between a second surface of the pilot piston and the cylinder. Another feature of this aspect of the present invention is that the equalizing plug is biased within the plug bore in a normally-closed position by a spring. Another feature of this aspect of the present invention is that the pilot activator is biased within the pilot bore in a normally-closed position by a spring.

In another aspect, the present invention may be an equalizing subsurface valve for controlling fluid flow in a well conduit, comprising: a body member having a longitudinal bore extending therethrough; a sleeve member disposed for movement within the longitudinal bore; an operating piston disposed within the body member and remotely shiftable to move the sleeve member within the longitudinal bore; a valve closure member mounted within the body member to control fluid flow through the longitudinal bore, and having a first surface and a second surface; a pilot activator movably disposed within a pilot bore in the valve closure member in response to movement of the sleeve member; a pilot piston movably disposed within a cylinder in the valve closure member, a first surface of the pilot piston being in fluid communication with the pilot bore through a pilot passageway in the valve closure member, the pilot activator alternately permitting and preventing fluid communication between the longitudinal bore adjacent the second surface of the valve closure member and the first surface of the pilot piston through the pilot passageway; and an equalizing plug movably disposed within a plug bore in the valve closure member in response to movement of the pilot piston, the equalizing plug alternately permitting and preventing fluid communication between the longitudinal bore adjacent the second surface of the valve closure member and the longitudinal bore adjacent the first surface of the valve closure member through at least one equalizing passageway in the valve closure member. Another feature of this aspect of the present invention is that the first surface of the pilot piston includes a first active surface area intermittently in fluid communication with fluid pressure in the longitudinal bore adjacent the second surface of the valve closure member through the pilot passageway, and the equalizing plug includes a head portion having a second active surface area in fluid communication with fluid pressure in the longitudinal bore adjacent the second surface of the valve closure member, the first active surface area being greater than the second active surface area Another feature of this aspect of the present invention is that the operating piston is a hydraulic operating piston that is moveable in response to application of hydraulic fluid and includes an operating piston surface area in communication with the hydraulic fluid; the pilot activator includes a pilot valve seat defined by a first annular sealing surface on the pilot activator and a second annular sealing surface about the pilot bore, the pilot valve seat defining a pilot surface area; the equalizing plug includes a plug valve seat defined by a third annular sealing surface on the equalizing plug and a fourth annular sealing surface within the valve, the plug valve seat defining a plug surface area; the pilot surface area is smaller than the operating piston surface area; and the plug surface area is greater than the operating piston surface area. Another feature of this aspect of the present invention is that the pilot activator includes a distal end extending from the pilot bore into the longitudinal bore above the first surface of the valve closure member when the pilot activator is in a closed position. Another feature of this aspect of the present invention is that the at least one equalizing passageway is disposed within the valve closure member. Another feature of this aspect of the present invention is that the valve closure member further includes an annular tapered surface joining the second surface of the valve closure member and the plug bore, and the at least one equalizing passageway establishes fluid communication between the first surface of the valve closure member and the tapered surface. Another feature of this aspect of the present invention is that the at least one equalizing passageway is an internal fluid passageway through the equalizing plug. Another feature of this aspect of the present invention is that the internal fluid flow passageway includes a generally longitudinal passageway extending from a second end of the equalizing plug and is in fluid communication with at least one generally radially-disposed opening exiting the plug at a location between the second end of the plug and the annular sealing surface of the plug. Another feature of this aspect of the present invention is that the pilot activator includes a first annular sealing surface for cooperable sealing engagement with a second annular sealing surface disposed about the pilot bore. Another feature of this aspect of the present invention is that at least one of the first and second annular sealing surfaces further includes a pliable annular sealing surface. Another feature of this aspect of the present invention is that the equalizing plug includes a third annular sealing surface adjacent a first end thereof for cooperable sealing engagement with a fourth annular sealing surface formed within the valve closure member. Another feature of this aspect of the present invention is that at least one of the third and fourth annular sealing surfaces further includes a pliable annular sealing surface. Another feature of this aspect of the present invention is that the equalizing plug further includes an internal fluid passageway for establishing fluid communication between the longitudinal bore adjacent the first surface of the valve closure member and an annular space formed between a second surface of the pilot piston and the cylinder. Another feature of this aspect of the present invention is that the equalizing plug is biased within the plug bore in a normally-closed position by a spring. Another feature of this aspect of the present invention is that the pilot activator is biased within the pilot bore in a normally-closed position by a spring.

In yet another aspect, the present invention may be a valve closure member mounted within a body member of an equalizing subsurface safety valve to control fluid flow through a longitudinal bore through the valve, comprising: a pilot activator movably disposed within a pilot bore in the valve closure member in response to movement of a sleeve member movably disposed in the longitudinal bore; a pilot piston movably disposed within a cylinder in the valve closure member, a first surface of the pilot piston being in fluid communication with the pilot bore through a pilot passageway in the valve closure member; an equalizing plug movably disposed within a plug bore in the valve closure member in response to movement of the pilot piston, the equalizing plug alternately permitting and preventing fluid communication between the longitudinal bore adjacent a second surface of the valve closure member and the longitudinal bore adjacent a first surface of the valve closure member through at least one equalizing passageway in the valve. Another feature of this aspect of the present invention is that the first surface of the pilot piston includes a first active surface area intermittently in fluid communication with fluid pressure in the longitudinal bore adjacent the second surface of the valve closure member through the pilot passageway, and the equalizing plug includes a head portion having a second active surface area in fluid communication with fluid pressure in the longitudinal bore adjacent the second surface of the valve closure member, the first active surface area being greater than the second active surface area. Another feature of this aspect of the present invention is that the operating piston is a hydraulic operating piston that is moveable in response to application of hydraulic fluid and includes an operating piston surface area in communication with the hydraulic fluid; the pilot activator includes a pilot valve seat defined by a first annular sealing surface on the pilot activator and a second annular sealing surface about the pilot bore, the pilot valve seat defining a pilot surface area; the equalizing plug includes a plug valve seat defined by a third annular sealing surface on the equalizing plug and a fourth annular sealing surface within the valve, the plug valve seat defining a plug surface area; the pilot surface area is smaller than the operating piston surface area; and the plug surface area is greater than the operating piston surface area. Another feature of this aspect of the present invention is that the pilot activator includes a distal end extending from the pilot bore into the longitudinal bore above the first surface of the valve closure member when the pilot activator is in a closed position. Another feature of this aspect of the present invention is that the at least one equalizing passageway is disposed within the valve closure member. Another feature of this aspect of the present invention is that the valve closure member further includes an annular tapered surface joining the second surface of the valve closure member and the plug bore, and the at least one equalizing passageway establishes fluid communication between the first surface of the valve closure member and the tapered surface. Another feature of this aspect of the present invention is that the at least one equalizing passageway is an internal fluid passageway through the equalizing plug. Another feature of this aspect of the present invention is that the internal fluid flow passageway includes a generally longitudinal passageway extending from a second end of the equalizing plug and is in fluid communication with at least one generally radially-disposed opening exiting the plug at a location between the second end of the plug and the annular sealing surface of the plug. Another feature of this aspect of the present invention is that the pilot activator includes a first annular sealing surface for cooperable sealing engagement with a second annular sealing surface disposed about the pilot bore. Another feature of this aspect of the present invention is that at least one of the first and second annular sealing surfaces further includes a pliable annular sealing surface. Another feature of this aspect of the present invention is that the equalizing plug includes a third annular sealing surface adjacent a first end thereof for cooperable sealing engagement with a fourth annular sealing surface formed within the valve closure member. Another feature of this aspect of the present invention is that at least one of the third and fourth annular sealing surfaces further includes a pliable annular sealing surface. Another feature of this aspect of the present invention is that the equalizing plug further includes an internal fluid passageway for establishing fluid communication between the longitudinal bore adjacent the second surface of the valve closure member and an annular space formed between a second surface of the pilot piston and the cylinder. Another feature of this aspect of the present invention is that the equalizing plug is biased within the plug bore in a normally-closed position by a spring. Another feature of this aspect of the present invention is that the pilot activator is biased within the pilot bore in a normally-closed position by a spring.

In still another aspect, the present invention may be a pressure-equalizing mechanism installed within an annular housing of a subsurface safety valve, the subsurface safety valve including a body member having a longitudinal bore extending therethrough, a valve closure member movably mounted within the body member, and a sleeve member remotely shiftable within the longitudinal bore to move the valve closure member between open and closed positions to control fluid flow through the longitudinal bore, the valve closure member having a first surface and a second surface, the pressure-equalizing mechanism including: a pilot activator movably disposed within a pilot bore in the annular housing in response to movement of the sleeve member; a pilot piston movably disposed within a cylinder in the annular housing, a first surface of the pilot piston being in fluid communication with the pilot bore through a pilot passageway in the annular housing, the pilot activator alternately permitting and preventing fluid communication between the longitudinal bore adjacent the second surface of the valve closure member and the first surface of the pilot piston through the pilot passageway; and an equalizing plug movably disposed within a plug bore in the annular housing in response to movement of the pilot piston, the equalizing plug alternately permitting and preventing fluid communication between the longitudinal bore adjacent the second surface of the valve closure member and the longitudinal bore adjacent the first surface of the valve closure member through at least one equalizing passageway. Another feature of this aspect of the present invention is that the sleeve member includes a first recessed profile and a second recessed profile; the pilot activator includes a distal end; the pilot activator is in a closed position and the distal end is disposed within the first recessed profile when the valve closure member is in a fully-open position; the pilot activator is in an open position and the distal end is disposed against an intermediate portion of the an outer surface of the sleeve member when the equalizing plug is in an equalizing position; and the pilot activator is in its closed position and the distal end is disposed within the second recessed profile when the valve closure member is in a fully-closed position. Another feature of this aspect of the present invention is that the first recessed profile includes a first inclined surface, a first flat surface, and a second inclined surface, and the second recessed profile includes a third inclined surface, a second flat surface, and a fourth inclined surface. Another feature of this aspect of the present invention is that the first inclined surface extends upwardly from the first flat surface to an outer surface of the sleeve member at an angle of approximately 45 degrees; the second inclined surface extends downwardly from the first flat surface to the outer surface of the sleeve member at an angle of approximately 10 degrees; the third inclined surface extends upwardly from the second flat surface to the outer surface of the sleeve member at an angle of approximately 10 degrees; and the fourth inclined surface extends downwardly from the second flat surface to the outer surface of the sleeve member an angle of approximately 45 degrees. Another feature of this aspect of the present invention is that the intermediate portion of the outer surface of the sleeve member intersects and is disposed between the second inclined surface of the first recessed profile and the third inclined surface of the second recessed profile. Another feature of this aspect of the present invention is that the mechanism may further include a series of baffles on an exterior surface of the annular housing and adjacent the longitudinal bore. Another feature of this aspect of the present invention is that the first surface of the pilot piston includes a first active surface area intermittently in fluid communication with fluid pressure in the longitudinal bore adjacent the second surface of the valve closure member through the pilot passageway, and the equalizing plug includes a head portion having a second active surface area in fluid communication with fluid pressure in the longitudinal bore adjacent the second surface of the valve closure member, the first active surface area being greater than the second active surface area. Another feature of this aspect of the present invention is that the subsurface safety valve further includes an operating piston disposed within the body member and remotely shiftable to move the sleeve member within the longitudinal bore; the operating piston is a hydraulic operating piston that is moveable in response to application of hydraulic fluid and includes an operating piston surface area in communication with the hydraulic fluid; the pilot activator includes a pilot valve seat defined by a first annular sealing surface on the pilot activator and a second annular sealing surface about the pilot bore, the pilot valve seat defining a pilot surface area; the equalizing plug includes a plug valve seat defined by a third annular sealing surface on the equalizing plug and a fourth annular sealing surface within the valve, the plug valve seat defining a plug surface area; the pilot surface area is smaller than the operating piston surface area; and the plug surface area is greater than the operating piston surface area. Another feature of this aspect of the present invention is that the at least one equal passageway is disposed within the annular housing. Another feature of this aspect of the present invention is that the at least one equalizing passageway is an internal fluid passageway through the equalizing plug. Another feature of this aspect of the present invention is that the internal fluid flow passageway includes a generally longitudinal passageway extending from a second end of the equalizing plug and is in fluid communication with at least one generally radially-disposed opening exiting the plug at a location between the second end of the plug and the annular sealing surface of the plug. Another feature of this aspect of the present invention is that the pilot activator includes a first annular sealing surface for cooperable sealing engagement with a second annular sealing surface disposed about the pilot bore. Another feature of this aspect of the present invention is that at least one of the first and second annular sealing surfaces further includes a pliable annular sealing surface. Another feature of this aspect of the present invention is that the equalizing plug includes a third annular sealing surface adjacent a first end thereof for cooperable sealing engagement with a fourth annular sealing surface formed within the annular housing. Another feature of this aspect of the present invention is that at least one of the third and fourth annular sealing surfaces further includes a pliable annular sealing surface. Another feature of this aspect of the present invention is that the equalizing plug is biased within the plug bore in a normally-closed position by a spring. Another feature of this aspect of the present invention is that the pilot activator is biased within the pilot bore in a normally-closed position by a spring.

In another aspect, the present invention may be an equalizing subsurface valve for controlling fluid flow in a well conduit, comprising: a body member having a longitudinal bore extending therethrough; a valve actuator disposed for movement within the longitudinal bore; means for controllably moving the valve actuator within the longitudinal bore; a valve closure member mounted within the body member to control fluid flow through the longitudinal bore; means for biasing the valve closure member to a normally-closed position to prevent fluid flow through the longitudinal bore; means for biasing the valve actuator away from the valve closure member; and pressure equalizing means responsive to movement of the valve actuator for permitting fluid pressure above and below the valve closure member to equalize before the valve closure member is opened to allow fluid flow through the longitudinal bore.

In another aspect, the present invention may be a method of equalizing pressure above and below a valve closure member in a subsurface safety valve prior to remotely shifting the valve closure member from a closed to an open position, comprising: shifting a valve actuator within a longitudinal bore of the subsurface safety valve into contact with a pilot activator disposed for reciprocal movement within a pilot bore in the valve; shifting the pilot activator within the pilot bore to establish fluid communication through a pilot passageway between the longitudinal bore adjacent a second surface of the valve closure member and a first surface of a pilot piston movably disposed within a cylinder in the valve; and establishing fluid communication between the second surface of the valve closure member and a first surface of the valve closure member.

DETAILED DESCRIPTION OF THE INVENTION

For purposes of the following description, it will be assumed that the present invention is installed within a subsurface valve of the type shown in U.S. Pat. No. 4,161,219, which type is commonly referred to as a rod-piston safety valve. However, it should be understood that the present invention can be used in any commercially available subsurface valve, whether it be tubing conveyed, wireline conveyed, hydraulically operated, mechanically operated, or electrically operated, and whether it has an annular or other type of piston. The present invention may also be used in ball-type or annulus subsurface safety valves.

Figure 1:
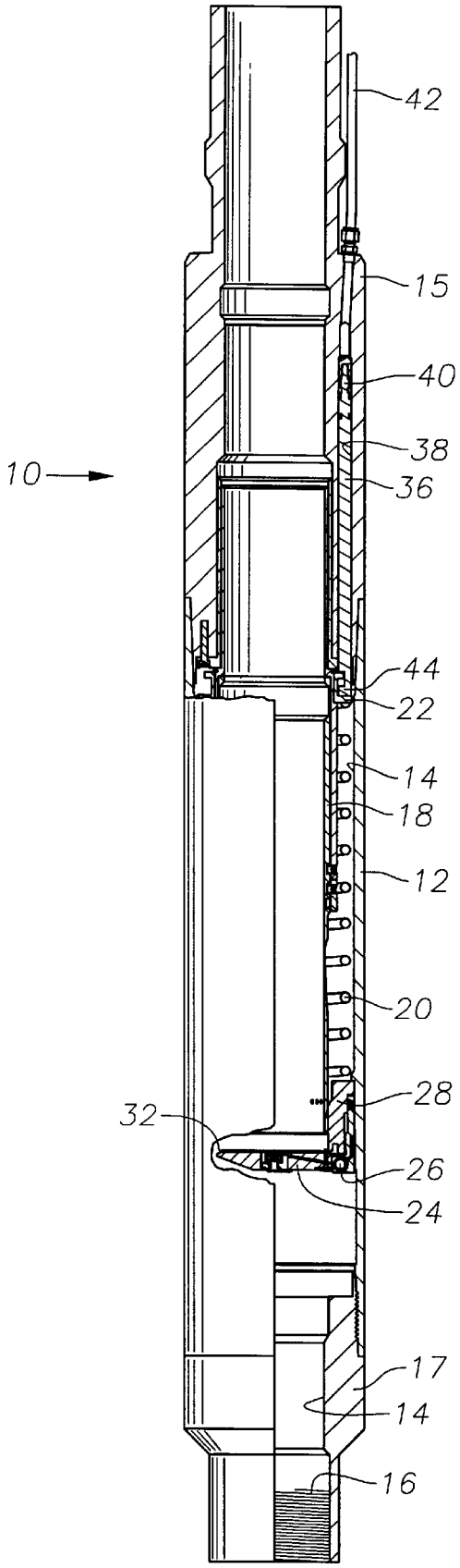
FIG. 1 is an elevational side view, partially in cross-section, showing a specific embodiment of the subsurface valve of the present invention with a flapper closure member shown in a closed position.
Figure 2:
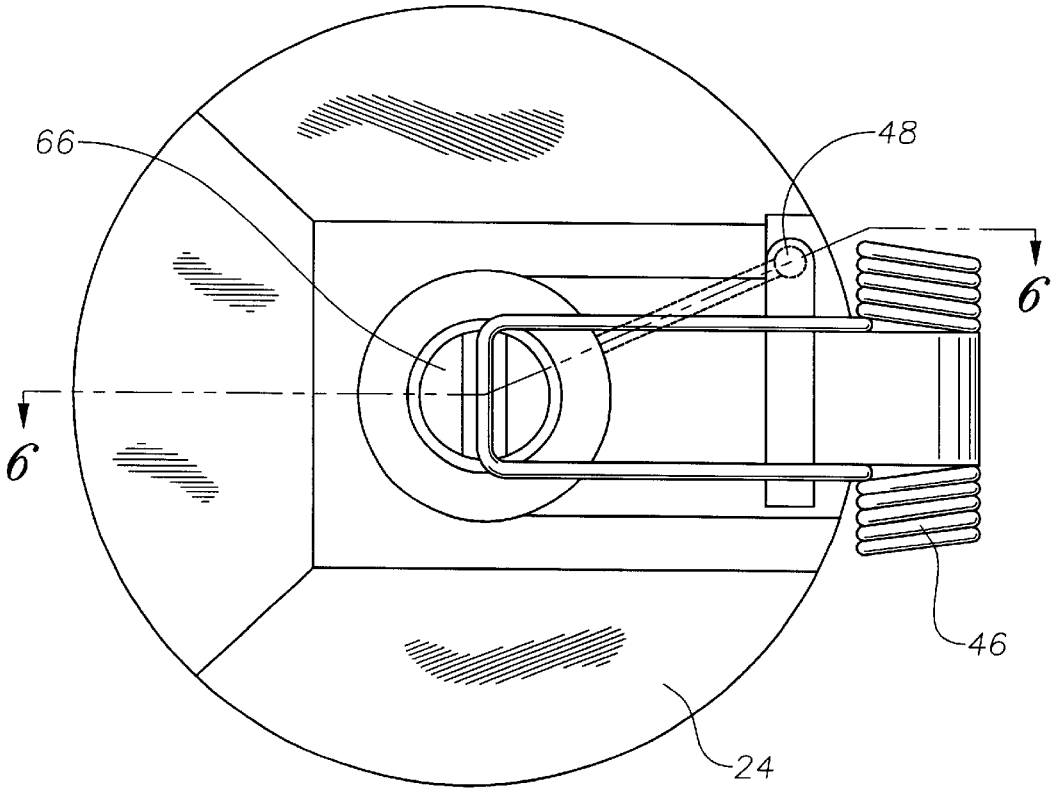
FIG. 2 is a bottom plan view of the flapper closure member shown in FIG. 1.
Figure 3:
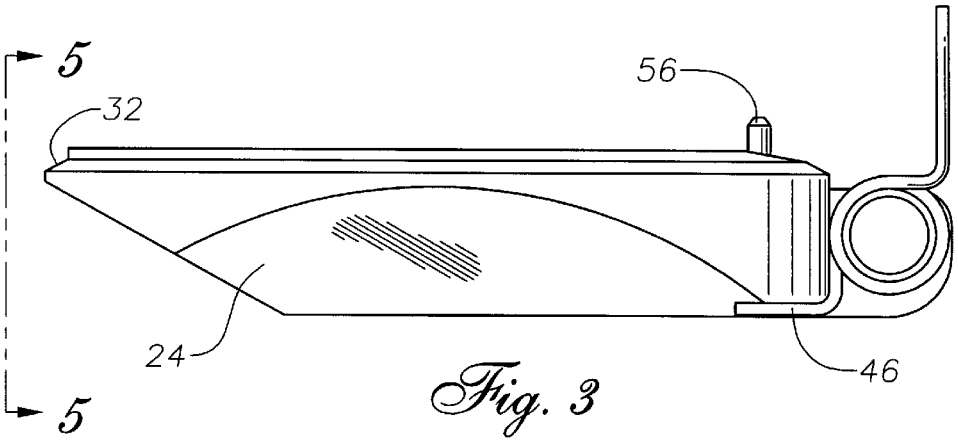
FIG. 3 is an elevational side view of the flapper closure member as shown in FIG. 2.
Figure 4:
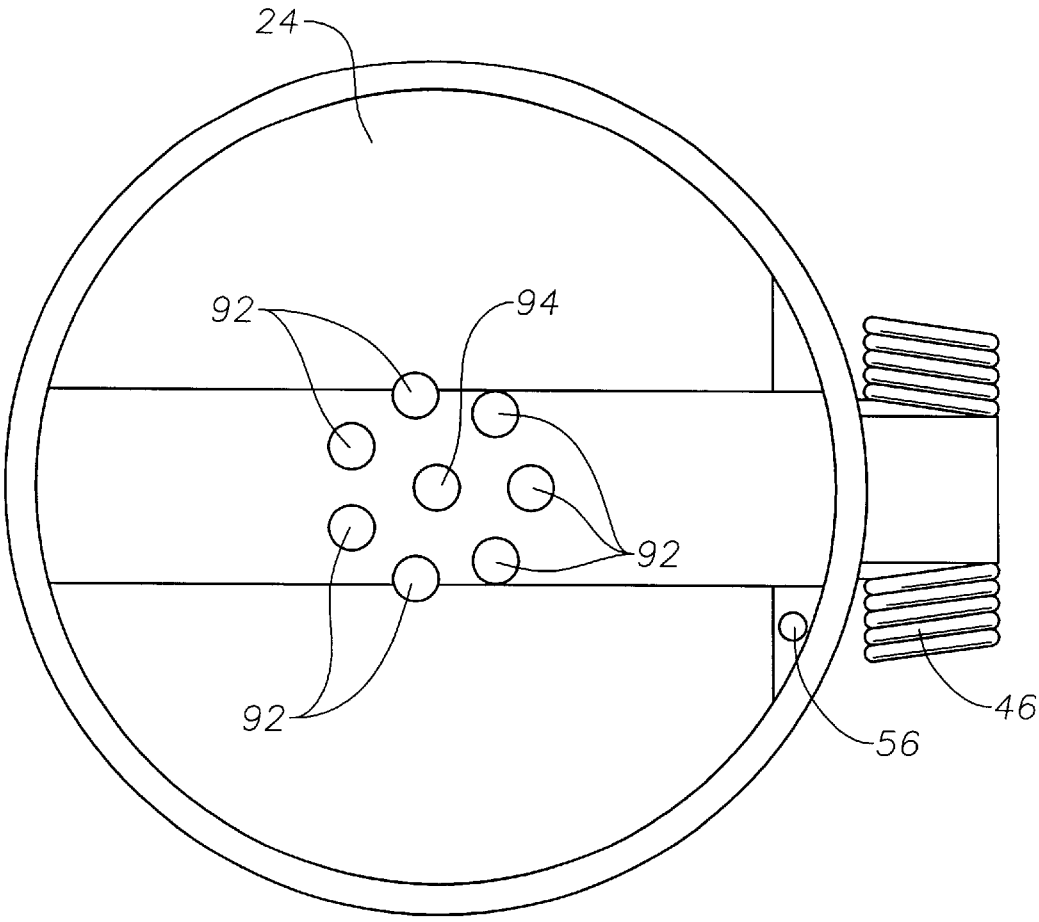
FIG. 4 is a top plan view of the flapper closure member as shown in FIGS. 2 and 3.
Figure 5:
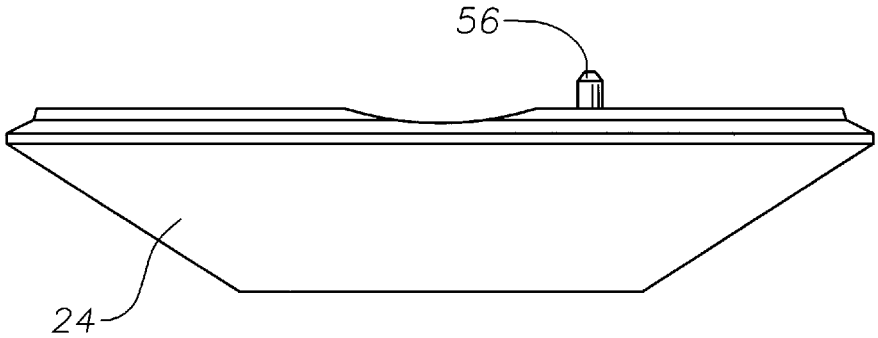
FIG. 5 is an elevational side view of the flapper closure member as shown in FIGS. 2–4, and taken along line 5—5 of FIG. 3.

Referring to the drawings in detail, wherein like numerals denote identical elements throughout the several views, there is shown in FIG. 1 a specific embodiment of a subsurface valve 10 constructed in accordance with the present invention. With reference to FIG. 1, the subsurface valve 10 of this specific embodiment is comprised of a generally tubular body 12 having a longitudinal bore 14 extending therethrough, a first end 15, and a second end 17. Each end of the body 12 includes mechanisms, such as threads 16, for interconnection with a pipe string (not shown) suspended within a wellbore (not shown). A sleeve member 18, sometimes also referred to as a flow tube, is disposed within the longitudinal bore 14 and is adapted for axial movement therein. A spring 20 is disposed around the flow tube 18 and acts upon a shoulder 22 on the flow tube 18 to bias the flow tube 18 away from a valve closure member 24, such as a flapper. The present invention is not intended to be limited to any particular means for biasing the flow tube 18 away from the flapper 24. For example, instead of, or in addition to, the spring 20, the valve 10 may utilize a balancing gas chamber (not shown), such as the types disclosed in U.S. Pat. Nos. 4,252,197 (Pringle), 4,660,646 (Blizzard), 4,976,317 (Leismer), and 5,310,004 (Leismer), all of which are commonly assigned hereto and incorporated herein by reference. Alternatively, the biasing means may be a control line (sometimes referred to as a balance line), either alone or in combination with one or more of the above-discussed return means, running from the earth's surface to force the flow tube 18 upwardly, such as disclosed in U.S. Pat. Nos. 4,495,998 and 4,621,695, which are commonly assigned hereto and incorporated herein by reference.

Figure 6:
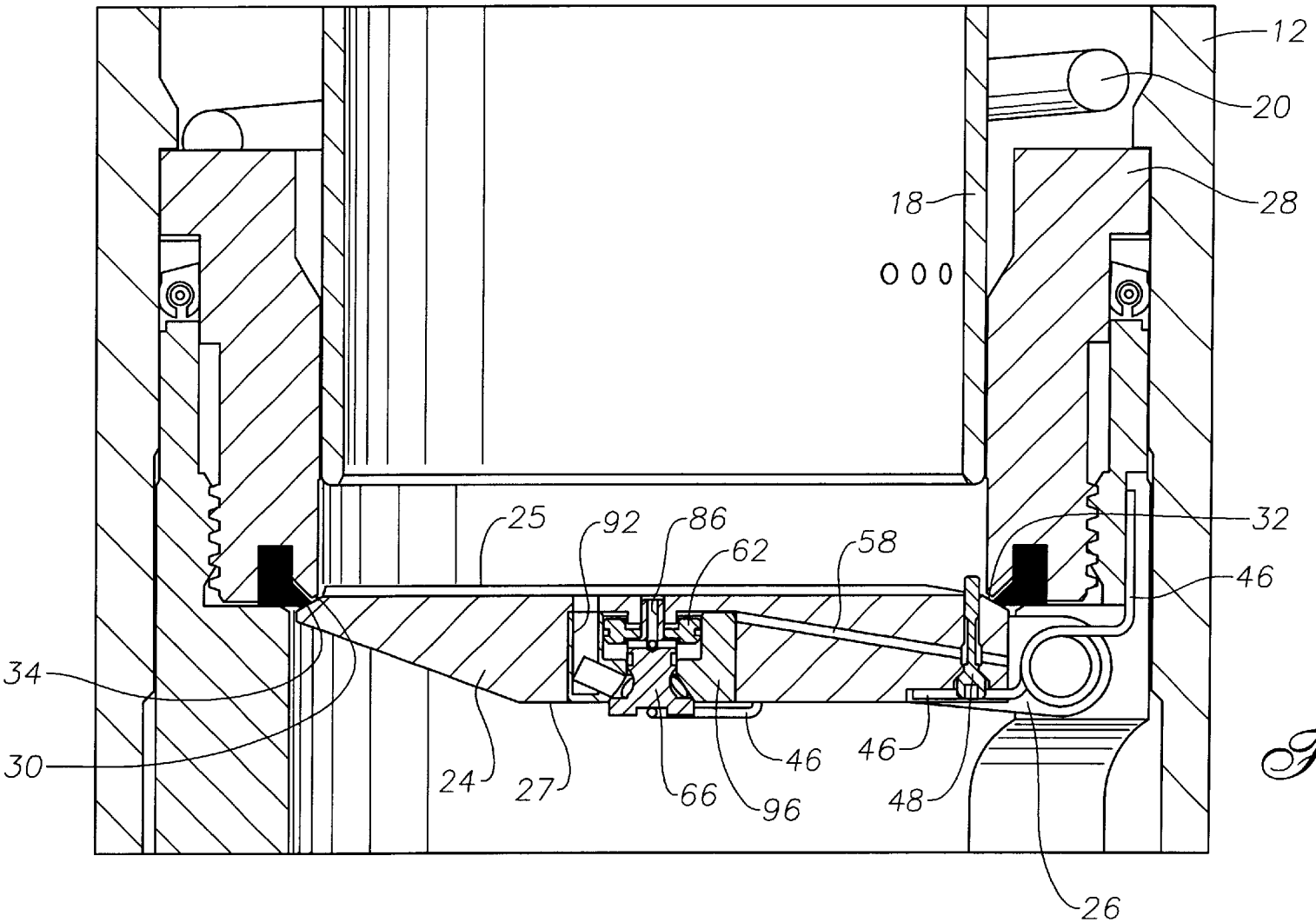
FIG. 6 is a fragmentary elevational side view, similar to FIG. 3, but in cross-section and taken along line 6—6 of FIG. 2, showing a specific embodiment of a pressure-equalizing mechanism of the present invention installed in the flapper closure member in the subsurface safety valve shown in FIG. 1, with the pressure-equalizing mechanism and the flapper closure member in closed positions.
Figure 7:
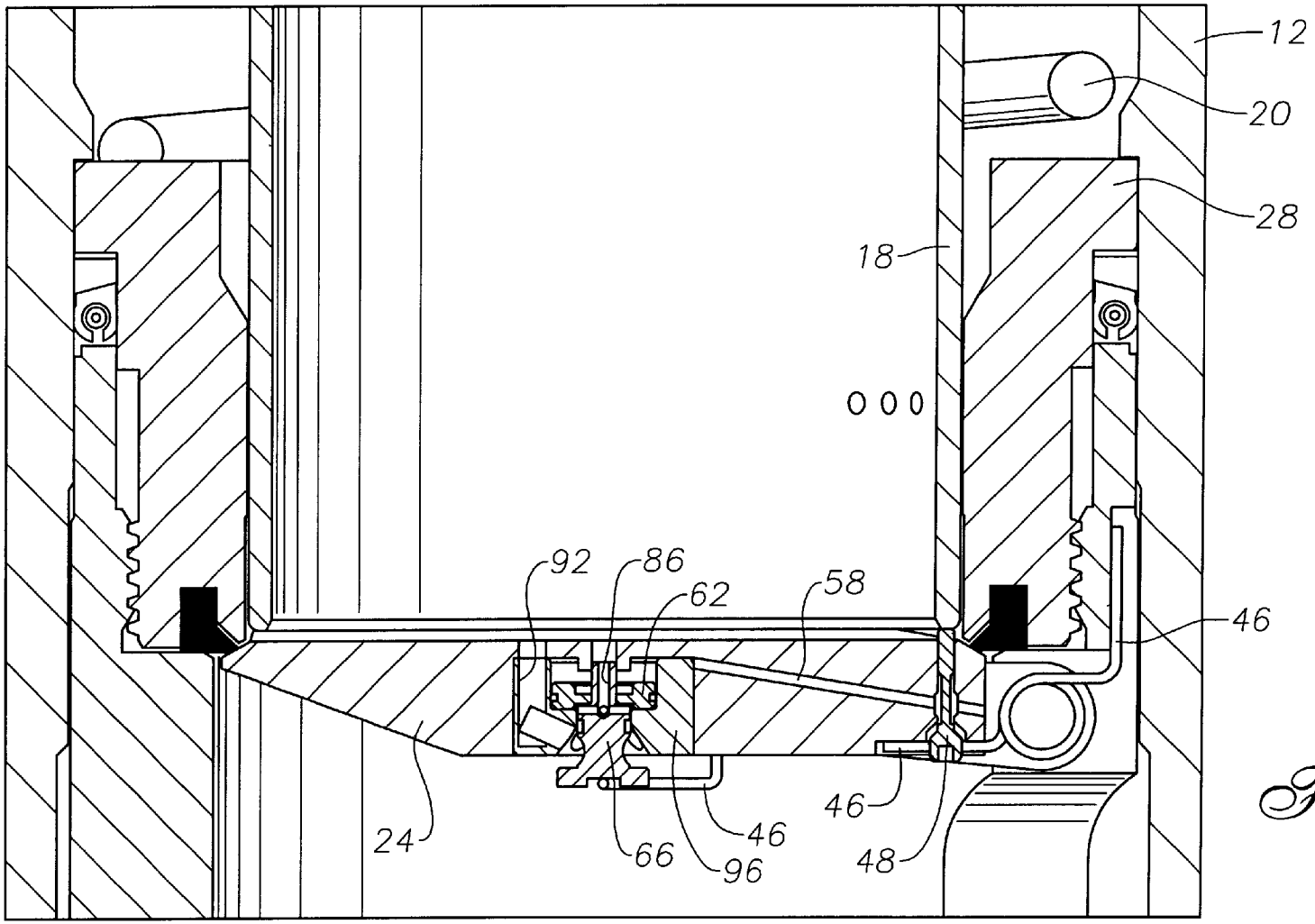
FIG. 7 is a fragmentary elevational view similar to FIG. 6, showing the flapper closure member still in its closed position, but the pressure-equalizing mechanism shifted to an open or pressure-equalizing position.

Referring to FIG. 6, the flapper 24 includes an arm 26 on a peripheral edge thereof that is hingedly connected to an annular housing 28 mounted within the bore 14. The flapper 24 further includes a first surface 25 and a second surface 27. The flapper 24 is also illustrated in FIGS. 2–5. In a specific embodiment, as shown in FIG. 6, the annular housing 28 may include a metallic annular sealing surface 30 cooperable with an annular sealing surface 32 on the flapper 24. In a specific embodiment, the annular housing 28 may further include a secondary annular sealing surface 34 formed from an annular body of pliable material, which is cooperable with the annular sealing surface 32 on the flapper 24. The metallic sealing surface 30 is generally referred to as the "hard seat" and the pliable sealing surface 34 is generally referred to as the "soft seat." In addition, for those embodiments wherein the pressure-equalizing mechanism of the present invention is installed in the annular housing 28 (see FIGS. 16–19, described below), the housing 28 may include a series of baffles or grooves 35 located on an exterior surface of the housing 28 and adjacent the longitudinal bore 14 of the body 12, the purpose of which will be explained below.

A valve actuator is provided within the body 12 and is remotely shiftable to permit an operator at the earth's surface to remotely open and close the flapper 24. The present invention is not limited to any particular type of valve actuator. Referring to FIG. 1, in a specific embodiment, the valve actuator may include the flow tube 18 that is disposed for movement within the longitudinal bore 14 and a operating piston that is remotely shiftable to move the flow tube 18 within the longitudinal bore to open and close the flapper 24. This embodiment may include any type of operating piston (e.g, rod-piston, annular, etc.). In a specific embodiment, as shown in FIG. 1, a rod-piston system may be provided to open the flapper 24, and may be comprised of an operating piston 36 sealably mounted for reciprocal movement within a cylinder 38 located within the wall of the tubular body 12. A first end 40 of the operating piston 36 is in communication with hydraulic fluid (not shown) provided thereto from the earth's surface (not shown) through a relatively small diameter control conduit 42. A second end 44 of the operating piston 36 may be operatively connected, in any suitable manner, to the flow tube 18. When the pressure of hydraulic fluid in the control conduit 42 exceeds the force needed to compress the spring 20 (and/or gas charge, balance line, etc.), the operating piston 36 is forced downwardly, thereby causing the flow tube 18 to move downwardly to come into contact with, and open, the flapper 24. In the event that the hydraulic pressure applied to the operating piston 36 is decreased, as by command from the earth's surface or by the control conduit 42 being damaged, the spring 20 (and/or gas charge, balance line, etc.) forces the flow tube 18 upwardly away from the flapper 24. The flapper 24 is then rotated, and biased, into a closed position by action of a hinge spring 46 (see, e.g., FIGS. 2–4) and/or well bore fluids to permit the annular sealing surfaces 30, 32 and 34 to mate and thereby establish a fluid seal to prevent fluid flow into the flow tube 18. As noted above, in the specific embodiment in which the valve actuator includes a flow tube 18 and an operating piston, the present invention is not limited to any particular type of operating piston. For purposes of illustration only, the subsurface valve shown in FIG. 1 uses hydraulic pressure applied through the control line 42 to a rod-piston assembly to move the flow tube 18. Other types of subsurface valves are within the scope of the present invention, including but not limited to, for example, valves which apply hydraulic pressure in the control line 42 to an annular operating piston disposed about the flow tube 18, in a manner known to those of skill in the art. In other specific embodiments, the valve actuator may be mechanically or electrically operated, in a manner well known to those of skill in the art.

As has been described above, when the flapper 24 has been closed, the pressure of fluids within the bore 14 upstream of (i.e., below) the closed flapper 24 increases and the pressure of the wellbore fluids downstream of (i.e., above) the closed flapper 24 decreases as the wellbore fluids remaining above the flapper 24 are recovered to the earth's surface (not shown). This may create a large pressure differential across the flapper 24 such that reopening of the flapper 24 becomes difficult. This difficulty in opening the flapper 24 cannot be easily overcome simply by increasing the force exerted against the flapper 24 by the flow tube 18, because the relatively small cross-sectional area of the operating piston 36 would require a fluid pressure that may burst the control conduit 42 carrying the hydraulic fluid, or destroy critical seals therein. The present invention solves this difficulty in opening the flapper 24 by providing a pressure-equalizing mechanism, described below, to allow the pressure above and below the flapper 24 to equalize prior to opening of the flapper 24, thereby reducing the force necessary to open the flapper 24. The pressure-equalizing mechanism of the present invention may be installed anywhere within the subsurface valve, including but not limited to, within the flapper 24, and within the annular housing 28.

Figure 8:
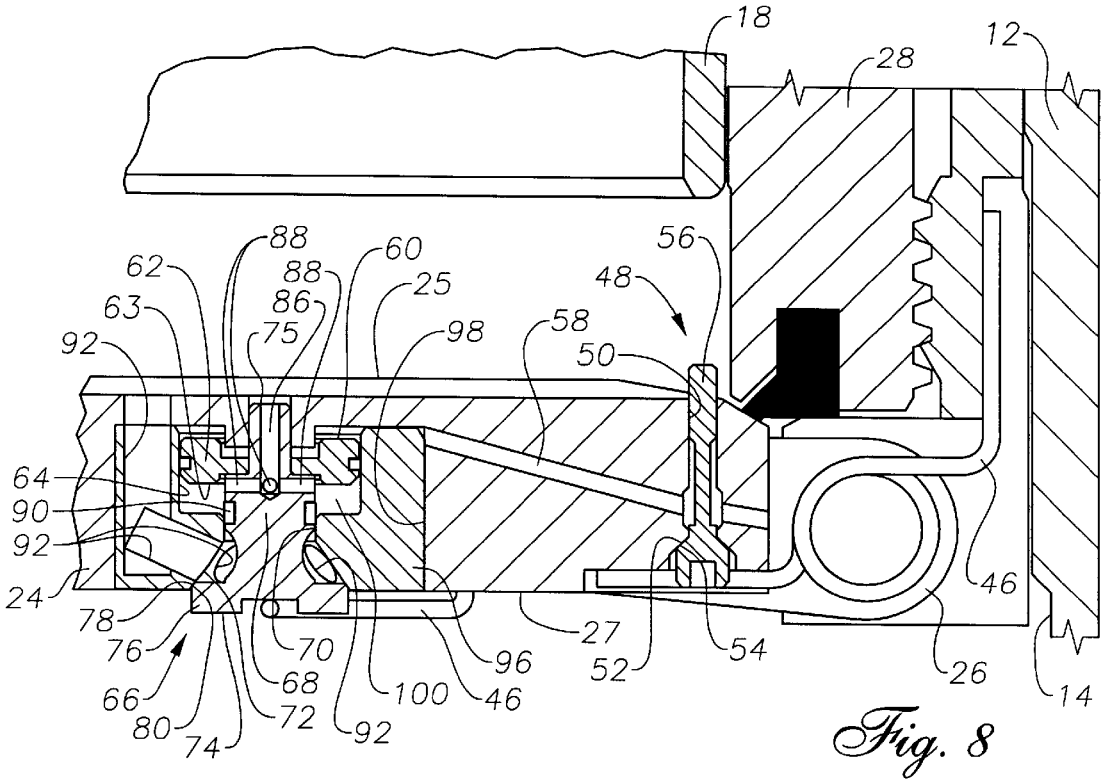
FIG. 8 is an enlarged fragmentary elevational view of a portion of FIG. 6, provided to better illustrate the details of the pressure-equalizing mechanism of the present invention.
Figure 12:
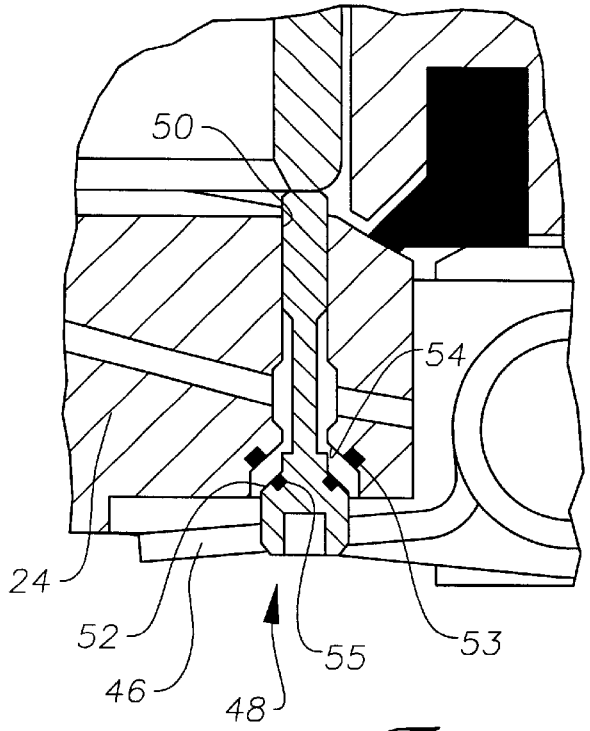
FIG. 12 is a partial elevational view illustrating optional secondary annular sealing surfaces, or "soft seats," associated with a pilot activator of the present invention.

A specific embodiment of the pressure-equalizing mechanism of the present invention will now be described. Referring initially to FIG. 8, the flapper 24 is shown biased in a normally-closed position by a torsion spring 46 to restrict fluid flow through the longitudinal bore 14 of the valve body 12. The flapper 24 includes a pilot activator 48 disposed for reciprocal movement within a pilot bore 50 through the flapper 24. In FIG. 8, the pilot activator 48 is shown biased by the spring 46 into a normally-closed, or sealing, position. The pilot activator 48 includes a first annular sealing surface 52 that cooperates with a second annular sealing surface 54 about the pilot bore 50 to prevent fluid flow therepast. In a specific embodiment, the first and second annular sealing surfaces 52 and 54 may each be metallic, so as to form a "hard seat." Alternatively, as shown in FIG. 12, either or both of the first and second annular sealing surfaces 52 and 54 may include a secondary annular sealing surface (or "soft seat") 53 and/or 55 formed from an annular body of pliable material. Preferably, a soft seat is used to ensure sealing when operating in low pressure differential applications. Referring again to FIG. 8, the pilot activator 48 further includes a distal end 56 that is shown in FIG. 8 extending from the pilot bore 50 into the longitudinal bore 14 above the first surface 25 of the flapper 24 when the pilot activator 48 is in its closed, or sealing, position. As will be more fully explained below in relation to FIG. 9, the pilot activator 48 is shiftable to an open, or equalizing, position by downward movement of the flow tube 18 into contact with the distal end 56 of the pilot activator 48. The distal end 56 is sized with a sufficiently close fit relative to the pilot bore 50 so as to permit only a minimal amount of fluid flow, if any, through the flapper 24 when the pilot activator 48 is in its open position (see FIG. 9). As shown in FIG. 8, the flapper 24 further includes a pilot passageway 58 that establishes fluid communication between the pilot bore 50 and a first surface 60 of a pilot piston 62 that is movably and sealably disposed within a cylinder 64 in the flapper 24. The pilot piston 62 is moveable in response to fluid pressure supplied from the longitudinal bore 14 adjacent the second surface 27 of the flapper 24 through the pilot passageway 58 when the pilot activator 48 is in its open, or equalizing, position (see FIG. 9). Movement of the pilot piston 62 results in movement of an equalizing plug 66, as will be more fully described below.

Figure 11:
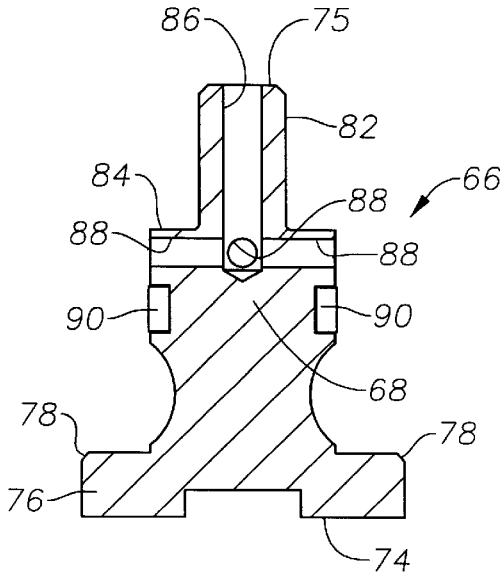
FIG. 11 is an elevational view, in cross-section, of a specific embodiment of an equalizing plug of the present invention.
Figure 13:
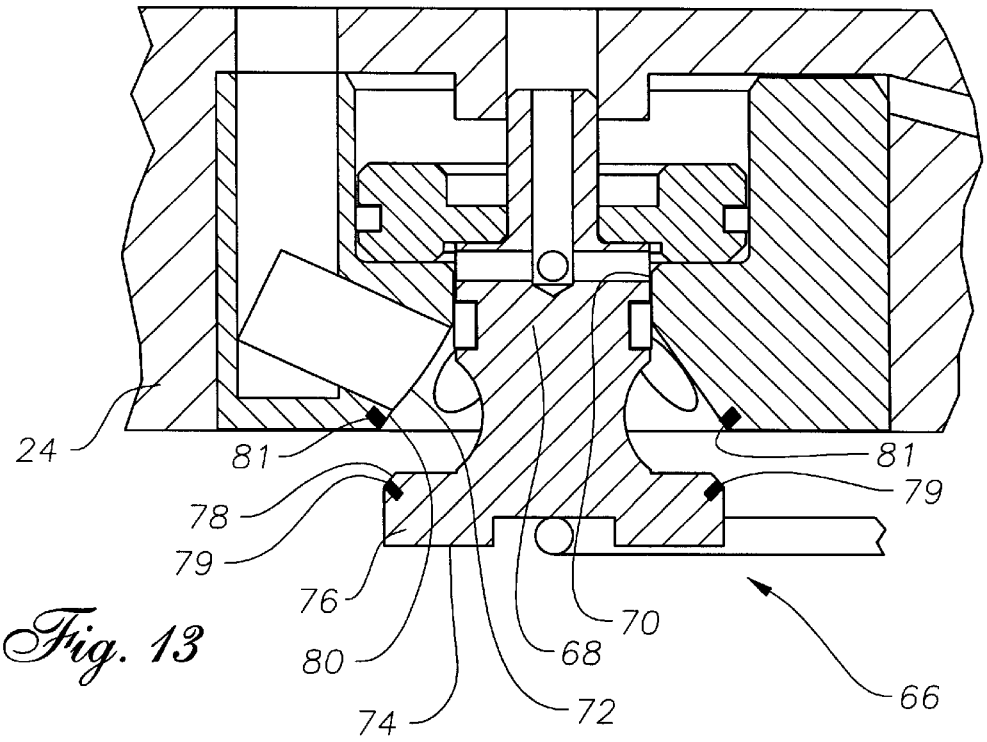
FIG. 13 is a partial elevational view illustrating optional secondary annular sealing surfaces, or "soft seats," associated with an equalizing plug of the present invention.

The equalizing plug 66 may include a generally cylindrical portion 68 sealably disposed for reciprocal movement within a plug bore 70 that may be disposed in the flapper 24 adjacent the cylinder 64. The flapper 24 may include an annular tapered surface 72 leading from the plug bore 70 to the second surface 27 of the flapper 24. A first end 74 of the plug 66 may include a head portion 76 having a third annular sealing surface 78 that cooperates with a fourth annular sealing surface 80 about the tapered surface 72 to prevent fluid flow therepast. In a specific embodiment, the third and fourth annular sealing surfaces 78 and 80 may each be metallic, so as to form a "hard seat." Alternatively, as shown in FIG. 13, either or both of the third and fourth annular sealing surfaces 78 and 80 may include a secondary annular sealing surface (or "soft seat") 79 and/or 81 formed from an annular body of pliable material. Preferably, a soft seat is used to ensure sealing when operating in low pressure differential applications. As shown in FIG. 8, the plug 66 is biased into a normally-closed position by the spring 46. For reasons that will be more fully explained below, the surface area of the head portion 76 that is exposed to well bore pressure below the flapper 24 is less than the surface area of the first surface 60 of the pilot piston 62, which may be alternately exposed to well bore pressure below the flapper 24 through the pilot passageway 58. As best shown in FIG. 11, a second end 75 of the plug 66 may include a stem 82 having a reduced diameter relative to the diameter of the cylindrical portion 68 so as to form a shoulder 84. The equalizing plug 66 may include an internal fluid passageway therethrough. More specifically, the stem 82 may include a generally longitudinal fluid passageway 86 extending from the second end 75 of the plug 66, and may be in fluid communication with at least one generally radially-disposed opening 88 that exits the equalizing plug 66 at a location on the generally cylindrical portion 68. The purpose of the passageway 86 and the openings 88 will be explained below. The cylindrical portion 68 may include an annular seal 90 to prevent fluid flow through any space between the cylindrical portion 68 and the plug bore 70 (see FIGS. 8 and 9). Referring back to FIG. 8, the flapper 24 may further include at least one equalizing passageway 92 that establishes fluid communication between the first surface 25 of the flapper 24 and the tapered surface 72. The flapper 24 may further include a stem bore 94 (see FIG. 9) extending from the first surface 25 of the flapper 24 to the cylinder 64. The plug stem 82 is sealably disposed for reciprocal movement within the stem bore 94. It is noted that, for manufacturing purposes, as will be readily apparent to one of ordinary skill in the art, the plug bore 70, the tapered surface 72, and the at least one equalizing passageway 92 may be located in an insert 96 that may be received within an insert bore 98 in the flapper 24, instead of being manufactured as part of the flapper 24 itself.

Figure 9:
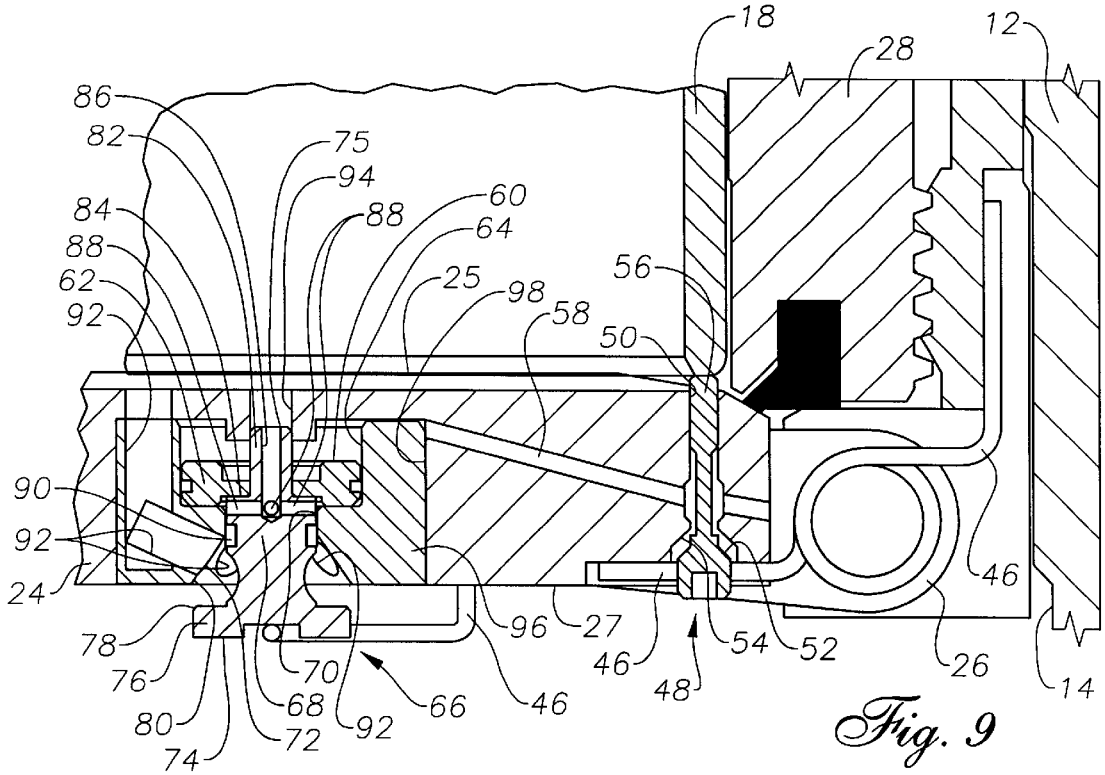
FIG. 9 is an enlarged fragmentary elevational view of a portion of FIG. 7, provided to better illustrate the details of the pressure-equalizing mechanism of the present invention.

With reference to FIG. 8, the flapper 24, the pilot activator 48 and the equalizing plug 66 are shown in their closed, or sealing, positions so as to restrict flow through the flow tube 18, the pilot passageway 58, and the at least one equalizing passageway 92, respectively. When it is desired to open the flapper 24, the flow tube 18 is forced towards the flapper 24 by the application of hydraulic fluid through the control conduit 42 (as has been described previously with regard to FIG. 1) or by electrical/mechanical action or simply mechanical action, depending upon the type of safety valve within which the present invention is included. As shown in FIG. 9, as the flow tube 18 is moved downwardly towards the flapper 24, it will come into contact with the distal end 56 of the pilot activator 48 before coming into contact with the first surface 25 of the flapper 24. It is noted that the flow tube 18 may be formed from material sufficiently hard to not be deformed, or galled, by contact with the pilot activator 48, or the portion of the flow tube 18 that experiences contact with the pilot activator 48 may include a hard coating. Continued downward movement of the flow tube 18 after coming into contact with the distal end 56 of the pilot activator 48 will move the pilot activator 48 downwardly within the pilot bore 50, thereby separating the first and second annular sealing surfaces 52 and 54 on the pilot activator 48 and pilot bore 50, respectively. In this manner, well bore fluids below the flapper 24 are permitted to flow into the pilot passageway 58 and into the cylinder 64 to apply pressure to the first surface 60 of the pilot piston 62. The pilot piston 62 may be disposed about the plug stem 82 of the equalizing plug 66, and has a second surface 63 (FIG. 8) that rests against the plug shoulder 84 (see FIG. 11). At this point, with reference to FIG. 9, note that both the pilot piston 62 and the head 76 of the equalizing plug 66 are exposed to the same pressure (i.e., the pressure in the longitudinal bore 14 of the valve body 12 adjacent the second surface 27 of the flapper 24). However, as briefly mentioned above, the surface area on the first surface 60 of the pilot piston 62 that is exposed to the well bore pressure is greater than the surface area on the head 76 of the equalizing plug 66 that is exposed to the well bore pressure; and because force equals the product of pressure and area, it follows that the downward force generated through the pilot piston 62 is greater than the upward force generated through the equalizing plug 66. As such, it can be seen that the well bore pressure below the flapper 24 is used to shift the equalizing plug 66 to its open position, as shown in FIG. 9, prior to the opening of the flapper 24. In this manner, the third and fourth annular sealing surfaces 78 and 80 on the plug 66 and tapered surface 72, respectively, are separated, thereby exposing the at least one equalizing passageway 92 through the flapper 24. Wellbore fluids below the flapper 24 will then flow through the at least one equalizing passageway 92 and into the flow tube 18, thereby permitting the fluid pressure above and below the flapper 24 to equalize prior to opening the flapper 24.

As noted above, the present invention encompasses various mechanisms for opening and closing the flapper 24 (e.g., hydraulically-operated, mechanically-operated, electrically-operated, etc.). For those embodiments of the present invention which include a hydraulically-operated valve actuator, the present invention presents a particular advantage over previous equalizing subsurface valves employing a hydraulically-operated valve actuator to shift an equalizing plug to an equalizing position, as will now be more fully explained. Typically, in such previous equalizing subsurface valves, there has been a relationship between the area of the hydraulic operating piston that is in communication with the hydraulic fluid (or operating piston surface area) and the area of the equalizing plug seat (or plug surface area). Specifically, the area of the equalizing plug seat (or plug surface area) could not be any greater than the area of the hydraulic operating piston (or operating piston surface area), otherwise it would not be possible to generate a force through the hydraulic operating piston large enough to shift the equalizing plug off seat to its equalizing position. As such, with these previous valves, the flow area across the equalizing plug (or plug surface area) is limited to the area defined by the hydraulic operating piston (or operating piston surface area). In applications involving high pressure or large volumes this limitation may be undesirable due to high erosional velocities and time to equalize. With the present invention, this limitation may be avoided by: (1) providing the pilot activator 48 with a relatively small diameter so that the surface area of its valve seat (or pilot surface area) defined by the first and second annular sealing surfaces 52 and 54 is smaller than the operating piston surface area, such as the area of the operating piston 36 shown in FIG. 1; and (2) providing the equalizing plug 66 with a relatively large diameter so that the surface area of its valve seat (or plug surface area) defined by the third and fourth annular sealing surfaces 78 and 80 is larger than the operating piston surface area In this manner, the flow area across the valve seat of the equalizing plug 66 is increased thereby reducing the time to equalize across the flapper 24 and resulting in lower equalizing velocities, which will extend the life of the valve seat of the equalizing plug 66.

The purpose of the longitudinal passageway 86 and the at least one generally radial opening 88 in the equalizing plug 66 shown in FIG. 11 will now be explained. Referring to FIG. 8, there is an annular space 100 within the flapper 24 that is formed by the second surface 63 of the pilot piston 62 and the cylinder 64 when the plug 66 is in its closed, or sealing, position. In the event there is any fluid in the annular space 100, then the ability of the pilot piston 62 to shift the plug 66 to its open position may be impeded, unless there is an escape route for any such fluid. As such, it may be desirable to provide a passageway through which such fluid may escape from the annular space 100 as the pilot piston 62 is moved downwardly to shift the plug 66 to its open position. In a specific embodiment, that passageway may be established through the at least one generally radial opening 88 and the longitudinal passageway 86 in the equalizing plug 66. It can now be seen that the at least one generally radial opening 88 exits the plug 66 at some point on the generally cylindrical portion 68 thereof so as to be in fluid communication with the annular space 100 throughout the range of movement of the plug 66 from its fully-open to its fully-closed position.

Figure 10:
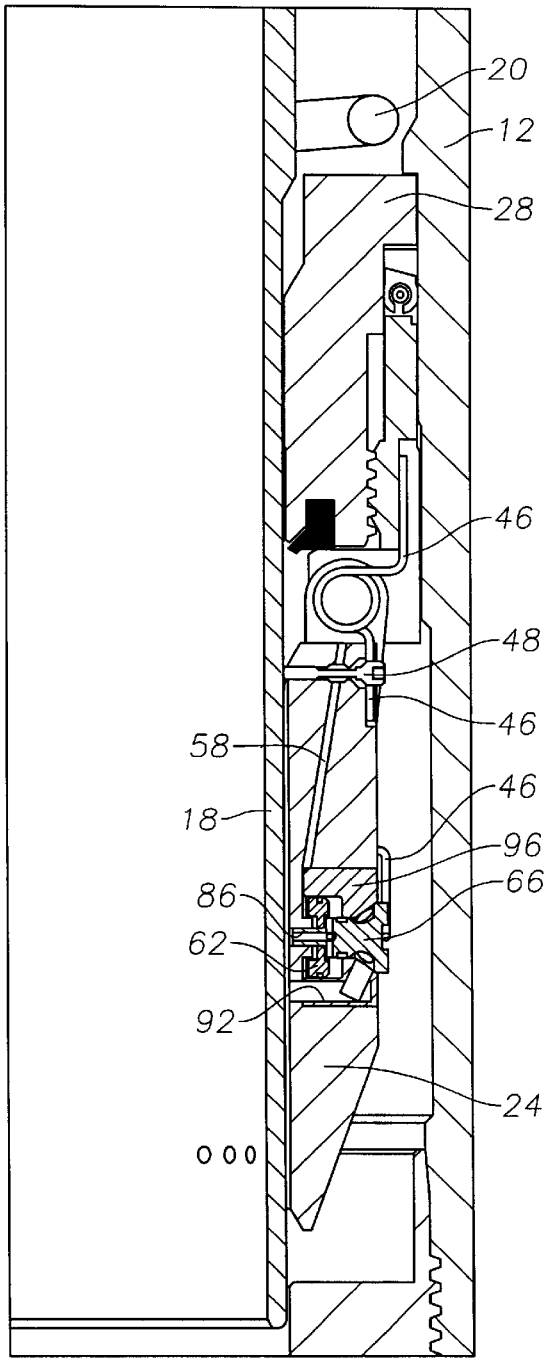
FIG. 10 is a fragmentary elevational view similar to FIGS. 6 and 7, showing the flapper closure member in a fully open position.

From the above discussion, it should now be apparent that the pressure differential across the flapper 24 is equalized through the at least one equalizing passageway 92 prior to the opening of the flapper 24. As such, the equalizing mechanism of the present invention prevents the initial relatively high velocity flow of fluids past the flapper 24 from damaging the annular sealing surfaces 30, 32, and 34 (see FIG. 6). To complete the opening of the flapper 24, the flow tube 18 is forced against the flapper 24 with sufficient force to overcome the force exerted by the spring 46, the force exerted by the flow-tube return means (e.g., spring 20, gas charge, balance line, etc.) and the force exerted by the pressure in the tubing below the flapper 24. The flow tube 18 pushes the flapper 24 open and holds it in the open position, as shown in FIG. 10, for so long as the hydraulic pressure from the control conduit 42 (or other force, depending on the type of subsurface valve) is applied. When the hydraulic pressure from the control conduit 42 (or other force) is reduced or removed, the return means (e.g., the spring 20) will cause the flow tube 18 to be moved away from the flapper 24 so that the flapper 24 will rotate to a closed position and the sealing surfaces 30, 32 and 34 will come into operative contact with each other to prevent fluid flow therepast.

Figure 14:
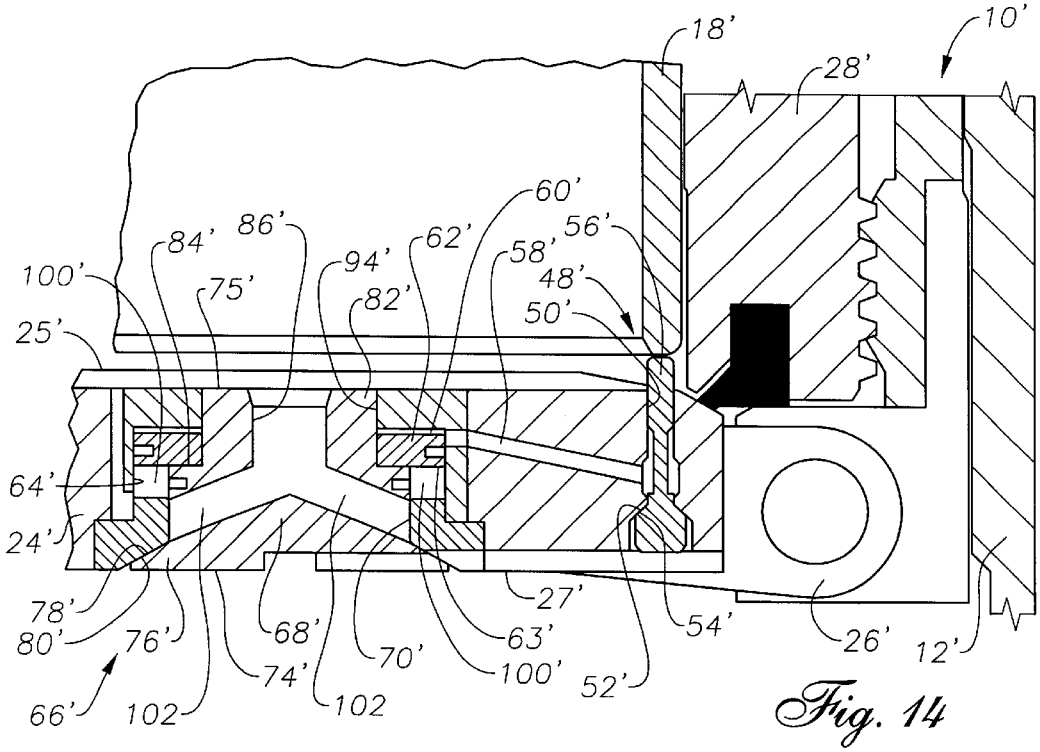
FIG. 14 is a fragmentary elevational view similar to FIG. 8, showing another specific embodiment of the pressure-equalizing mechanism of the present invention installed in the flapper closure member in the subsurface safety valve shown in FIG. 1, with the pressure-equalizing mechanism and the flapper closure member in closed positions.
Figure 15:
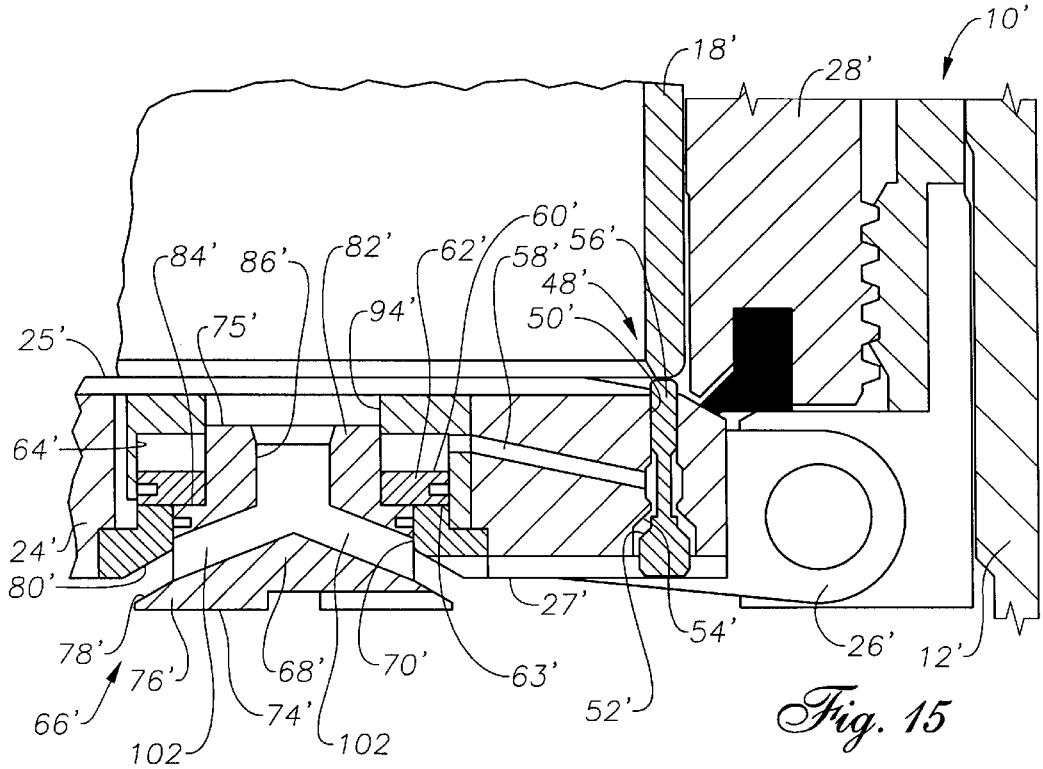
FIG. 15 is a fragmentary elevational view similar to FIG. 9, showing the flapper closure member still in its closed position, but the pressure-equalizing mechanism shifted to an open or pressure-equalizing position.

Another specific embodiment of the present invention will now be described with reference to FIGS. 14 and 15. Referring initially to FIG. 14, a flapper 24' is shown that is similar to the flapper 24 shown in FIGS. 1–13, with the primary exception being as follows: with the flapper 24 shown in FIGS. 1–13, pressure is equalized above and below the flapper 24 through the at least one equalizing passageway 92 in the flapper 24, whereas with the flapper 24' shown in FIGS. 14 and 15, pressure is equalized through an internal fluid passageway in the equalizing plug 66'. Unless otherwise indicated, all other features of the flapper 24' are the same as discussed above with regard to the flapper 24. As such, where there are no changes, the same references numerals will be used in FIGS. 14 and 15, but will be differentiated with a superscript prime marking. The basic structural components of the equalizing plug 66' shown in FIGS. 14 and 15 are the same as on the equalizing plug 66 shown in FIGS. 1–13, except that the at least one generally radial opening 102 shown in FIGS. 14 and 15 exits the plug 66' at a different location relative to the location at which the at least one generally radial opening 88 exits the plug 66 (see, e.g, FIGS. 8, 9 and 11). More specifically, the at least one generally radial opening 88 shown in FIG. 8 exits the generally cylindrical portion 68 of the plug 66 at a location so as to establish communication between the annular space 100 and the longitudinal passageway 86 in the plug 66 throughout the range of motion of the plug 66 from its fully-closed to its fully-open positions. In contrast, the at least one generally radial opening 102 shown in FIGS. 14 and 15 exits the generally cylindrical portion 68' of the plug 66' at a location between the third annular sealing surface 78' on the plug head portion 76' and the plug shoulder 84' so as to establish fluid communication between the longitudinal bore 14' below the flapper 24' when the plug 66' is in its open, or equalizing, position. When the plug 66' is in its closed, or sealing, position, however, fluid communication between the longitudinal bore 14' below the flapper 24' is prevented by virtue of sealing contact between the third and fourth annular sealing surfaces 78' and 80' on the plug 66' and flapper 24', respectively. These structural differences in the equalizing plugs 66/66' derive from the difference in the purpose of the internal fluid passageway formed through the plug 66 by the longitudinal passageway 86 and the at least one generally radial opening 88, best shown in FIG. 11, versus the purpose of the internal fluid passageway formed through the plug 66' by the longitudinal passageway 86' and the at least one generally radial opening 102, as shown in FIGS. 14 and 15. More specifically, recall that the purpose of the internal fluid passageway in the plug 66 (see, e.g, FIGS. 8 and 9) is to provide an escape route for fluid captured within the annular space 100, whereas the purpose of the internal fluid passageway in the plug 66' (FIGS. 14–15) is to provide a passageway through which relatively-high-pressure well bore fluids below the flapper 24' may flow from below to above the flapper 24' prior to the opening of the flapper 24'.

The operation of the specific embodiment of the present invention shown in FIGS. 14–15 is basically the same as explained above with regard to the specific embodiment of the present invention shown in FIGS. 1–13, except for the location of the equalizing fluid passageway, as explained in the preceding paragraph. Briefly, in the embodiment of FIGS. 14–15, the flow tube 18' moves downwardly to shift the pilot activator 48' downwardly within the pilot bore 50' from the position shown in FIG. 14 to the position shown in FIG. 15 to allow well bore fluids below the flapper 24' to flow through the pilot passageway 58' into communication with the first surface 60' of the pilot piston 62'. Due to the differences in the active surface areas of the pilot piston 62' and the plug head 76', the pressure applied to the pilot piston 62' will force the plug 66' downwardly from the position shown in FIG. 14 to the position shown in FIG. 15 so as to separate the sealing surfaces 78' and 80' to permit well bore fluids to flow from the longitudinal bore 14' below the flapper 24' through the internal fluid passageway in the plug 66' (i.e., through the openings 102 and the longitudinal passageway 86') and into the flow tube 18'.

The embodiments described above and illustrated in FIGS. 1–15 show the pressure-equalizing mechanism of the present invention installed within the flapper 24/24'. However, as mentioned above, the pressure-equalizing mechanism of the present invention may also be installed at other locations within the subsurface valve, including, for example, within the annular housing 28. A specific embodiment of this aspect of the present invention will now be described with reference to FIGS. 16–19.

Figure 16:
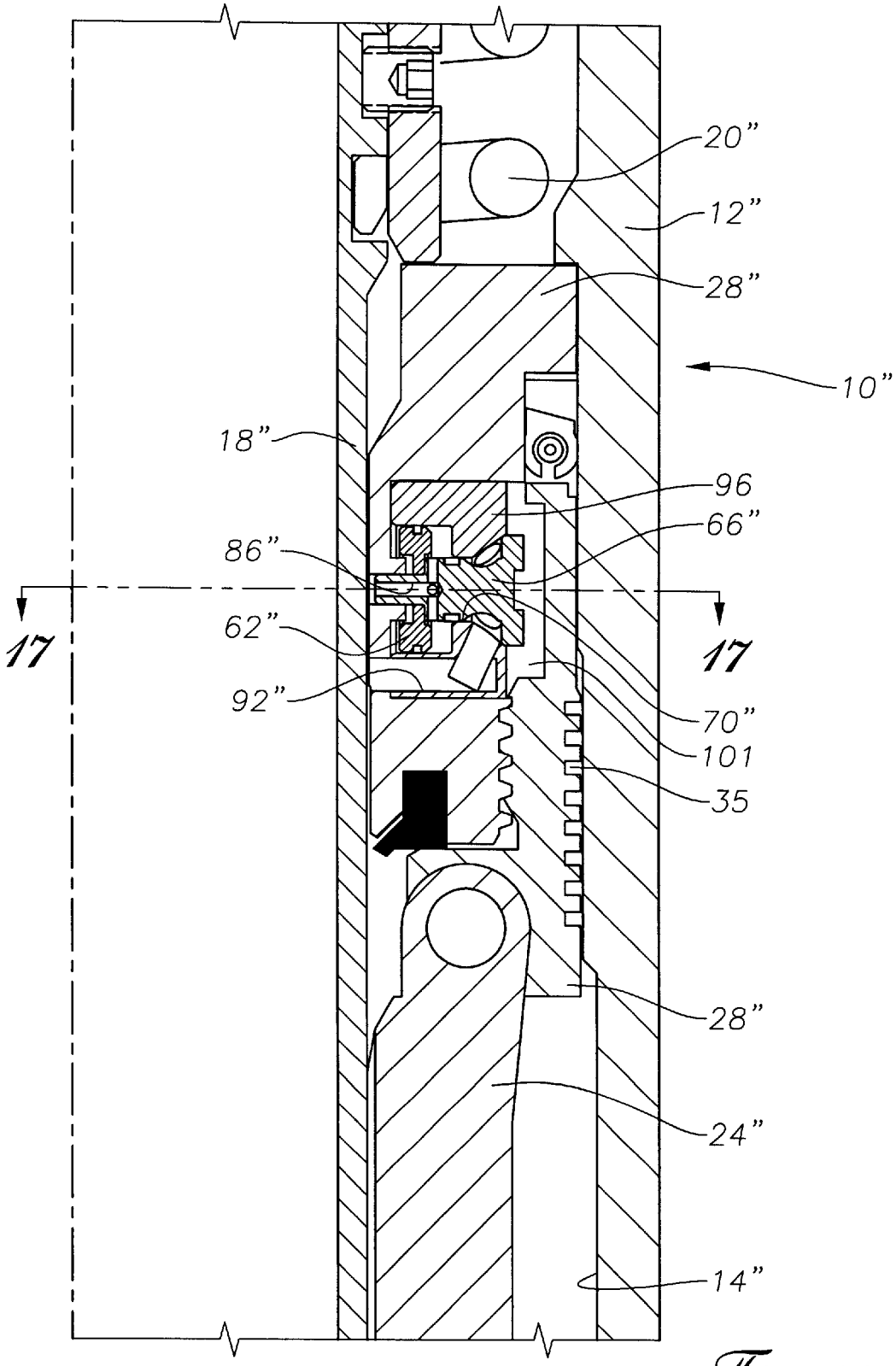
FIG. 16 is a fragmentary elevational view, in cross-section, showing another specific embodiment of the pressure-equalizing mechanism of the present invention installed in an annular housing in the subsurface safety valve shown in FIG. 1, with the pressure-equalizing mechanism and the flapper closure member in closed positions.
Figure 17:
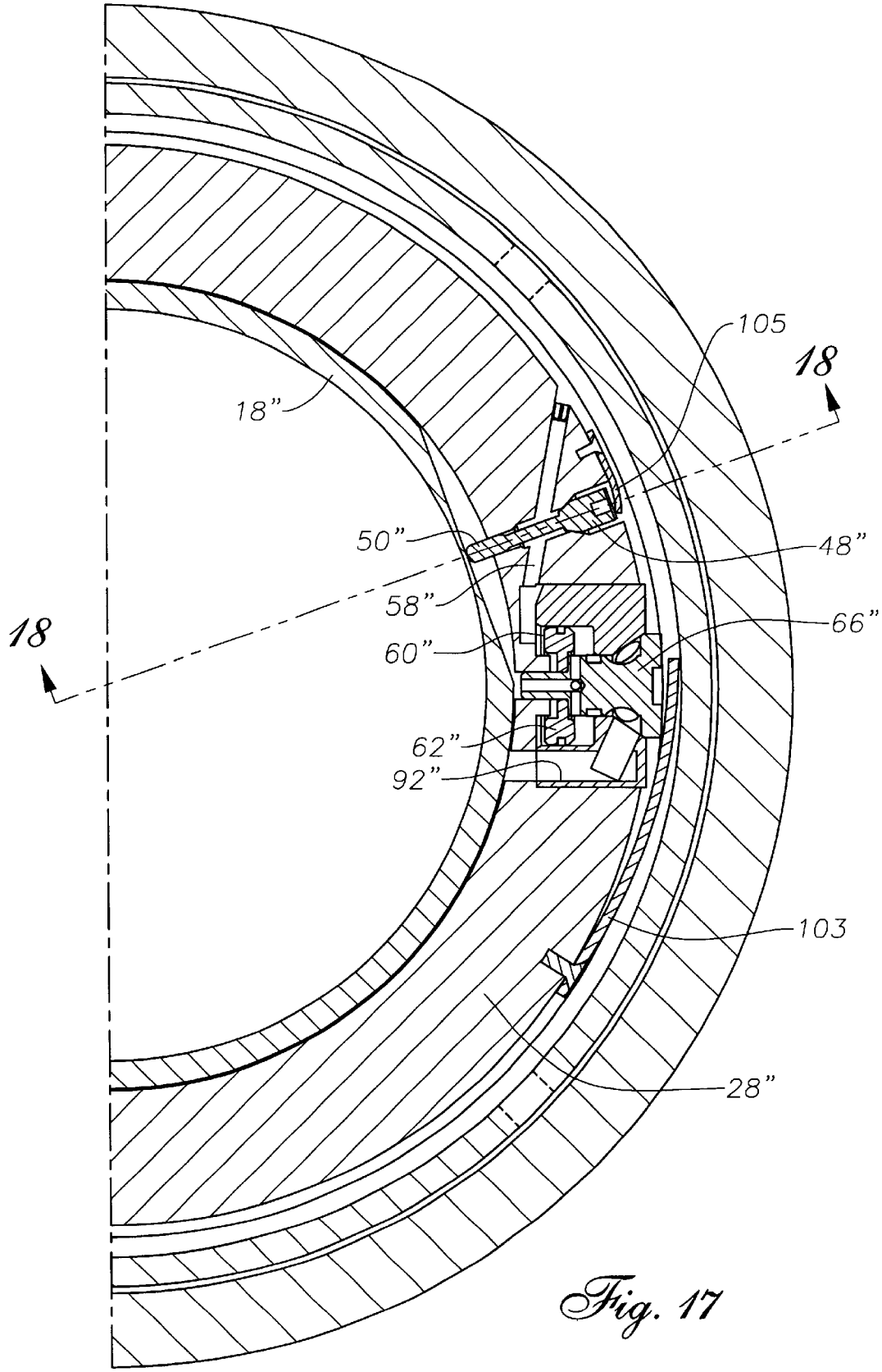
FIG. 17 is a cross-sectional view taken along line 17—17 of FIG. 16.

FIG. 16 shows the flapper 24" rotated to its fully-open position and being held in that position by the flow tube 18". The equalizing plug 66" is shown disposed for reciprocal movement within the plug bore 70" in the annular housing 28". The structure and operation of the equalizing plug 66" may be the substantially the same as for the equalizing plug 66 described above and illustrated in FIGS. 6–11 and 13. In a specific embodiment, the plug 66" may be contained with a space 101 formed within the annular housing 28". In another specific embodiment, as shown in FIG. 17, the safety valve 10" may include a spring 103 connected to the housing 28" for biasing the plug 66" into its closed position. A difference between the plug 66 shown in FIGS. 6–11 and the plug 66" shown in FIGS. 16 and 17 is that, when the flapper 24 is in its fully-closed position, the plug 66 of FIGS. 6–11 may be disposed for movement along an axis substantially parallel to an axis along which the flow tube 18 moves, whereas the plug 66" of FIGS. 16–17 may be diseased for movement along an axis substantially perpendicular to the axis along which the flow tube 18" moves, irrespective of the position of the flapper 24". FIG. 16 also illustrates the series of baffles or grooves 35 referenced hereinabove, which are located on an exterior surface of the housing 28" and adjacent the longitudinal bore 14" of the body 12". The series of baffles or grooves 35 operate to induce a pressure drop so as to reduce erosion as the well fluids flow through the at least one equalizing passageway 92", and also reduce the amount of debris (e.g., sand) that may be entrained in the fluids from flowing through the at least one equalizing passageway 92".

Referring now to FIG. 17, which is a cross-sectional view taken along line 17—17 of FIG. 16, the pilot activator 48" of this embodiment is shown disposed for reciprocal movement within the pilot bore 50" in the annular housing 28". In another specific embodiment, as shown in FIG. 17, the safety valve 10" may include a spring 105 connected to the housing 28" for biasing the pilot activator 48" into its closed position. The structure and operation of the pilot activator 48" is the same as for the pilot activator 48 described above and illustrated in FIGS. 6–12, except with regard to the way in which the flow tube 18/18" shifts the pilot activator 48/48" to establish fluid communication from below the flapper 24/24" through the pilot passageway 58/58" to the first surface 60/60" of the pilot piston 62/62". The manner in which the flow tube 18" shifts the pilot activator 48" between its open and closed positions can best be explained with reference to FIGS. 18 and 19.

Figure 18:
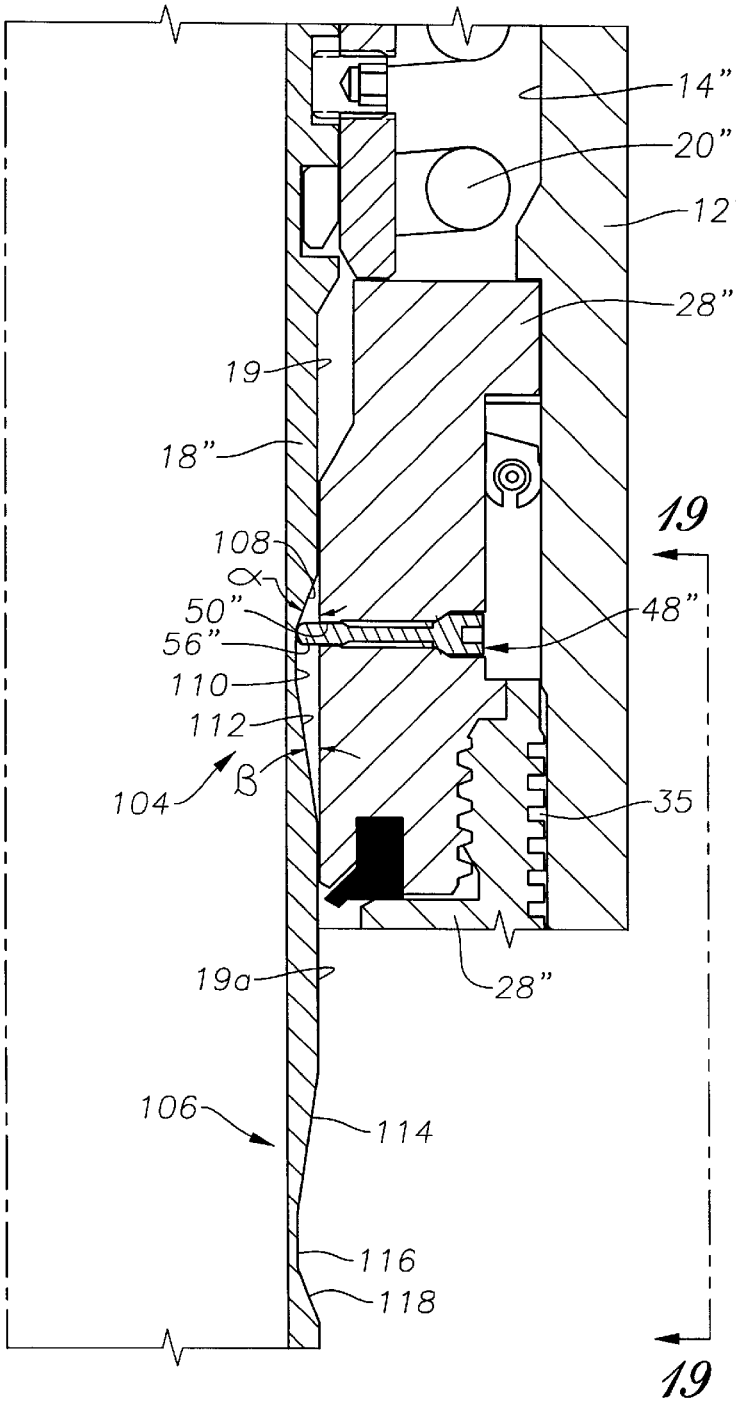
FIG. 18 is a longitudinal, fragmentary cross-sectional view taken along line 18—18 of FIG. 17, and illustrating first and second recessed profiles in a flow tube of the present invention.
Figure 19:
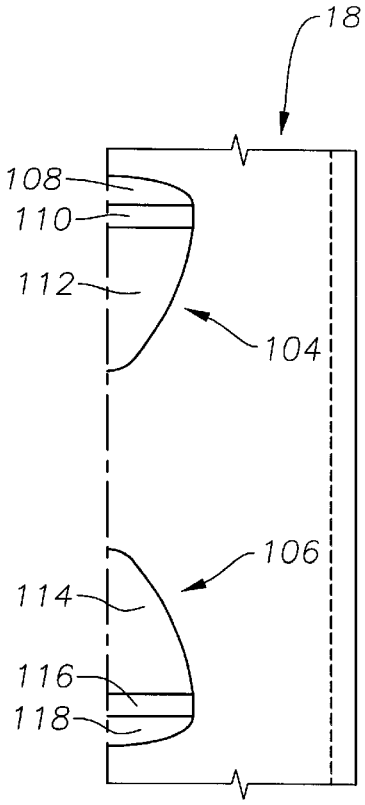
FIG. 19 is a partial elevational view of the flow tube shown in FIG. 18, and is taken in the direction as shown by line 19—19 of FIG. 18.

Referring now to FIGS. 18 and 19, the flow tube 18" may include a first and a second recessed profile 104 and 106. The first recessed profile 104 may include a first inclined surface 108, a first flat surface 110, and a second inclined surface 112. In a specific embodiment, the first inclined surface 108 may extend upwardly from the first flat surface 110 to an outer surface 19 of the flow tube 18" at an angle $\alpha$ of approximately 45 degrees. In a specific embodiment, the second inclined surface 112 may extend downwardly from the first flat surface 110 to the outer surface 19 of the flow tube 18" at an angle $\beta$ of approximately 10 degrees. The second recessed profile 106 may include a third inclined surface 114, a second flat surface 116, and a fourth inclined surface 118. In a specific embodiment, the angles of the third inclined surface 114 and the fourth inclined surface 118 may be the same as set forth above with regard to the angles of the second inclined surface 112 and the first inclined surface 108, respectively. An intermediate portion 19*a* of the outer surface 19 of the flow tube 18" intersects and is disposed between the second inclined surface 112 of the first recessed profile 104 and the third inclined surface 114 of the second recessed profile 106.

FIGS. 16–18 illustrate the flow tube 18" in a lower position, holding the flapper 24" in its fully-open position. As shown in FIG. 18, when the flow tube 18" is in this position, the pilot activator 48" is in its fully-closed, or sealing, position, and its distal end 56" is received within the first recessed profile 104 of the flow tube 18" adjacent the first flat surface 110. As shown in FIGS. 16 and 17, the equalizing plug 66" is also in its fully-closed, or sealing, position when the flow tube 18" is in its lower position. When pressure in the control line 42 (recall FIG. 1) is removed from the piston 36 (FIG. 1), the flow tube 18" will be moved upwardly away from the flapper 24", thereby permitting the flapper 24" to rotate to its fully-closed position (see, e.g., FIG. 6). During this closing process, with reference to FIG. 18, the distal end 56" of the pilot activator 48" will move along the second inclined surface 112, onto the intermediate portion 19*a* of the outer surface 19 of the flow tube 18", and along the third inclined surface 114. When the flow tube 18" comes to rest in an upper position, which corresponds to the fully-closed position of the flapper 24" (see, e.g., FIG. 6), the pilot activator 48" will be in its fully-closed, or sealing, position, and its distal end 56" will be received within the second recessed profile 106 of the flow tube 18" adjacent the second flat surface 116. After the flapper 24" rotates to its fully-closed position, well bore fluids above the flapper 24" will be recovered to the earth's surface (not shown) and a pressure differential may form across the flapper 24".

When it becomes desirable to reopen the flapper 24", for reasons explained above, it may be necessary to overcome this pressure differential prior to opening of the flapper 24". This embodiment of the present invention enables such pressure equalization prior to opening of the flapper 24", as will now be explained. By applying pressurized fluid to the piston 36 (FIG. 1) through the control line 42, the flow tube 18" will be forced downwardly. In this manner, the distal end 56" of the pilot activator 48" will move along the third inclined surface 114 and onto the intermediate portion 19*a* of the outer surface 19 of the flow tube 18", thereby shifting the pilot activator 48" to its open, or equalizing, position. The flow tube 18" is momentarily held in this position (i.e., with the distal end 56" of the pilot activator 48" resting against the intermediate portion 19*a*), long enough for relatively high-pressure well bore fluids to flow through the pilot passageway 58" (see FIG. 17) into communication with the pilot piston 62" to shift the equalizing plug 66" into its open, or equalizing, position. Well bore fluids will then flow through the at least one equalizing passageway 92" in the annular housing 28", thereby allowing pressure above and below the flapper 24" to equalize. After pressure has equalized, the flow tube 18" may then be shifted further downwardly to move the flapper 24" to its fully-open position, at which time the distal end 56" of the pilot activator 48" will be disposed within the first recessed profile 104 adjacent the first flat surface 110, as shown in FIG. 18, and both the pilot activator 48" and the equalizing plug 66" will return to their fully-closed, or sealing, positions, as shown in FIGS. 16–18.

It is noted that, by providing the first recessed profile 104 to enable the pilot activator 48" and the equalizing plug 66" to return to their closed positions, the various sealing surfaces (see, e.g., surfaces 52, 54, 78 and 80 in FIG. 9) of the pilot activator 48" and the equalizing plug 66" will only be briefly exposed to the potentially-damaging well bore fluids. It is further noted that the first inclined surface 108 of the first recessed profile 104 is provided so the distal end 56" of the pilot activator 48" will not prevent downward movement of the flow tube 18" to a position lower than that shown in FIGS. 16–18, in the event it becomes desirable to shift the flow tube 18" into a locked-out position (not shown).

It is to be understood that the invention is not limited to the exact details of construction, operation, exact materials or embodiments shown and described, as obvious modifications and equivalents will be apparent to one skilled in the art. For example, the present invention is not limited to any particular type of equalizing plug 66. In this regard, while the side-wall mounted embodiment of the present invention of FIGS. 16–19 is illustrated with an equalizing plug 66 as illustrated in FIG. 11, the side-wall mounted embodiment may instead include an equalizing plug 66' as illustrated in FIGS. 14 and 15. In addition, while the disclosure herein is directed to a flapper-type subsurface safety valve, it will be readily apparent to one of ordinary skill in the art that the pilot-operated pressure-equalizing mechanism of the present invention may be easily and conveniently adapted for use in ball-type or annular safety valves. Additionally, the present invention may be adapted for use in any of a number of downhole tools that are designed to close off flow issuing from a well thereby establishing a pressure differential thereacross, wherein such pressure differential represents an obstacle to the reopening of the tool. Accordingly, the invention is therefore to be limited only by the scope of the appended claims.

What is claimed is:

1. An equalizing subsurface valve for controlling fluid flow in a well conduit, comprising:

a body member having a longitudinal bore extending therethrough;

a valve closure member mounted within the body member to control fluid flow through the longitudinal bore, and having a first surface and a second surface;

a valve actuator disposed within the body member and remotely shiftable to move the valve closure member between open and closed positions;

a pilot activator movably disposed within a pilot bore in the valve in response to movement of the valve actuator;

a pilot piston movably disposed within a cylinder in the valve, a first surface of the pilot piston being in fluid communication with the pilot bore through a pilot passageway in the valve, the pilot activator alternately permitting and preventing fluid communication between the longitudinal bore adjacent the second surface of the valve closure member and the first surface of the pilot piston through the pilot passageway; and, an equalizing plug movably disposed within a plug bore in the valve in response to movement of the pilot piston, the equalizing plug alternately permitting and preventing fluid communication between the longitudinal bore adjacent the second surface of the valve closure member and the longitudinal bore adjacent the first surface of the valve closure member through at least one equalizing passageway in the valve.

2. The equalizing subsurface valve of claim 1, wherein the first surface of the pilot piston includes a first active surface area intermittently in fluid communication with fluid pressure in the longitudinal bore adjacent the second surface of the valve closure member through the pilot passageway, and the equalizing plug includes a head portion having a second active surface area in fluid communication with fluid pressure in the longitudinal bore adjacent the second surface of the valve closure member, the first active surface area being greater than the second active surface area.

3. The equalizing subsurface valve of claim 1, wherein the valve actuator includes a sleeve member disposed for movement within the longitudinal bore and an operating piston disposed within the body member and remotely shiftable to move the sleeve member within the longitudinal bore.

4. The equalizing subsurface valve of claim 3, wherein the operating piston is a rod piston movably disposed within a cylinder in the body member with one side of the operating piston adapted to be in communication with a source of hydraulic fluid for moving the sleeve member within the longitudinal bore.

5. The equalizing subsurface valve of claim 3, wherein:

the operating piston is a hydraulic operating piston that is moveable in response to application of hydraulic fluid and includes an operating piston surface area in communication with the hydraulic fluid;

the pilot activator includes a pilot valve seat defined by a first annular sealing surface on the pilot activator and a second annular sealing surface about the pilot bore, the pilot valve seat defining a pilot surface area;

the equalizing plug includes a plug valve seat defined by a third annular sealing surface on the equalizing plug and a fourth annular sealing surface within the valve, the plug valve seat defining a plug surface area;

the pilot surface area is smaller than the operating piston surface area; and the plug surface area is greater than the operating piston surface area.

6. The equalizing subsurface valve of claim 1, wherein the pilot activator includes a distal end extending from the pilot bore into the longitudinal bore above the first surface of the valve closure member when the pilot activator is in a closed position.

7. The equalizing subsurface valve of claim 1, wherein the pilot bore, the pilot passageway, the cylinder, and the plug bore are disposed within the valve closure member.

8. The equalizing subsurface valve of claim 1, wherein the pilot bore, the pilot passageway, the cylinder, and the plug bore are disposed within an annular housing connected to the valve body.

9. The equalizing subsurface valve of claim 8, wherein the valve actuator includes a sleeve member having a first recessed profile and a second recessed profile, a distal end of the pilot activator being disposed within the first recessed profile when the valve closure member is in a fully-open position, against an intermediate portion of the an outer surface of the sleeve member when the pilot activator and equalizing plug are in equalizing positions, and within the second recessed profile when the valve closure member is in a fully-closed position.

10. The equalizing subsurface value of claim 1, wherein the at least one equalizing passageway is disposed within an annular housing disposed within the body member.

11. The equalizing subsurface valve of claim 1, wherein the at least one equalizing passageway is disposed within the valve closure member.

12. The equalizing subsurface valve of claim 11, wherein the valve closure member further includes an annular tapered surface joining the second surface of the valve closure member and the plug bore, and the at least one equalizing passageway establishes fluid communication between the first surface of the valve closure member and the tapered surface.

13. The equalizing subsurface valve of claim 1, wherein the at least one equalizing passageway is an internal fluid passageway through the equalizing plug.

14. The equalizing subsurface valve of claim 13, wherein the internal fluid flow passageway includes a generally longitudinal passageway extending from a second end of the equalizing plug and is in fluid communication with at least one generally radially-disposed opening exiting the plug at a location between the second end of the plug and the annular sealing surface of the plug.

15. The equalizing subsurface valve of claim 1, wherein the pilot activator includes a first annular sealing surface for cooperable sealing engagement with a second annular sealing surface disposed about the pilot bore.

16. The equalizing subsurface valve of claim 15, wherein at least one of the first and second annular sealing surfaces further includes a pliable annular sealing surface.

17. The equalizing subsurface valve of claim 1, wherein the equalizing plug includes a first annular sealing surface adjacent a first end thereof for cooperable sealing engagement with a second annula sealing surface formed within the valve closure member.

18. The equalizing subsurface valve of claim 17, wherein at least one of the first and second annular sealing surfaces further includes a pliable annular sealing surface.

19. The equalizing subsurface valve of claim 1, wherein the equalizing plug further includes an internal fluid passageway for establishing fluid communication between the longitudinal bore adjacent the first surface of the valve closure member and an annular space formed between a second surface of the pilot piston and the cylinder.

20. The equalizing subsurface valve of claim 1, wherein the equalizing plug is biased within the plug bore in a normally-closed position by a spring.

21. The equalizing subsurface valve of claim 1, wherein the pilot activator is biased within the pilot bore in a normally-closed position by a spring.

22. An equalizing subsurface valve for controlling fluid flow in a well conduit, comprising:

a body member having a longitudinal bore extending therethrough;

a sleeve member disposed for movement within the longitudinal bore;

an operating piston disposed within the body member and remotely shiftable to move the sleeve member within the longitudinal bore;

a valve closure member mounted within the body member to control fluid flow through the longitudinal bore, and having a first surface and a second surface;

a pilot activator movably disposed within a pilot bore in the valve closure member in response to movement of the sleeve member;

a pilot piston movably disposed within a cylinder in the valve closure member, a first surface of the pilot piston being in fluid communication with the pilot bore through a pilot passageway in the valve closure member, the pilot activator alternately permitting and preventing fluid communication between the longitudinal bore adjacent the second surface of the valve closure member and the first surface of the pilot piston through the pilot passageway; and, an equalizing plug movably disposed within a plug bore in the valve closure member in response to movement of the pilot piston, the equalizing plug alternately permitting and preventing fluid communication between the longitudinal bore adjacent the second surface of the valve closure member and the longitudinal bore adjacent the first surface of the valve closure member through at least one equalizing passageway in the valve closure member.

23. The equalizing subsurface valve of claim 22, wherein the first surface of the pilot piston includes a first active surface area intermittently in fluid communication with fluid pressure in the longitudinal bore adjacent the second surface of the valve closure member through the pilot passageway, and the equalizing plug includes a head portion having a second active surface area in fluid communication with fluid pressure in the longitudinal bore adjacent the second surface of the valve closure member, the first active surface area being greater than the second active surface area.

24. The equalizing subsurface valve of claim 22, wherein:

the operating piston is a hydraulic operating piston that is moveable in response to application of hydraulic fluid and includes an operating piston surface area in communication with the hydraulic fluid;

the pilot activator includes a pilot valve seat defined by a first annular sealing surface on the pilot activator and a second annular sealing surface about the pilot bore, the pilot valve seat defining a pilot surface area;

the equalizing plug includes a plug valve seat defined by a third annular sealing surface on the equalizing plug and a fourth annular sealing surface within the valve, the plug valve seat defining a plug surface area;

the pilot surface area is smaller than the operating piston surface area; and the plug surface area is greater than the operating piston surface area.

25. The equalizing subsurface valve of claim 22, wherein the pilot activator includes a distal end extending from the pilot bore into the longitudinal bore above the first surface of the valve closure member when the pilot activator is in a closed position.

26. The equalizing subsurface valve of claim 22, wherein the at least one equalizing passageway is disposed within the valve closure member.

27. The equalizing subsurface valve of claim 26, wherein the valve closure member further includes an annular tapered surface joining the second surface of the valve closure member and the plug bore, and the at least one equalizing passageway establishes fluid communication between the first surface of the valve closure member and the tapered surface.

28. The equalizing subsurface valve of claim 22, wherein the at least one equalizing passageway is an internal fluid passageway through the equalizing plug.

29. The equalizing subsurface valve of claim 28, wherein the internal fluid flow passageway includes a generally longitudinal passageway extending from a second end of the equalizing plug and is in fluid communication with at least one generally radially-disposed opening exiting the plug at a location between the second end of the plug and the annular sealing surface of the plug.

30. The equalizing subsurface valve of claim 22, wherein the pilot activator includes a first annular sealing surface for cooperable sealing engagement with a second annular sealing surface disposed about the pilot bore.

31. The equalizing subsurface valve of claim 30, wherein at least one of the first and second annular sealing surfaces further includes a pliable annular sealing surface.

32. The equalizing subsurface valve of claim 22, wherein the equalizing plug includes a first annular sealing surface adjacent a first end thereof for cooperable sealing engagement with a second annular sealing surface formed within the valve closure member.

33. The equalizing subsurface valve of claim 32, wherein at least one of the first and second annular sealing surfaces further includes a pliable annular sealing surface.

34. The equalizing subsurface valve of claim 22, wherein the equalizing plug further includes an internal fluid passageway for establishing fluid communication between the longitudinal bore adjacent the first surface of the valve closure member and an annular space formed between a second surface of the pilot piston and the cylinder.

35. The equalizing subsurface valve of claim 22, wherein the equalizing plug is biased within the plug bore in a normally-closed position by a spring.

36. The equalizing subsurface valve of claim 22, wherein the pilot activator is biased within the pilot bore in a normally-closed position by a spring.

37. A valve closure member mounted within a body member of an equalizing subsurface safety valve to control fluid flow through a longitudinal bore through the valve, comprising:

a pilot activator movably disposed within a pilot bore in the valve closure member in response to movement of a sleeve member movably disposed in the longitudinal bore;

a pilot piston movably disposed within a cylinder in the valve closure member, a first surface of the pilot piston being in fluid communication with the pilot bore through a pilot passageway in the valve closure member; and an equalizing plug movably disposed within a plug bore in the valve closure member in response to movement of the pilot piston, the equalizing plug alternately permitting and preventing fluid communication between the longitudinal bore adjacent a second surface of the valve closure member and the longitudinal bore adjacent a first surface of the valve closure member through at least one equalizing passageway in the valve.

38. The valve closure member of claim 37, wherein the first surface of the pilot piston includes a first active surface area intermittently in fluid communication with fluid pressure in the longitudinal bore adjacent the second surface of the valve closure member through the pilot passageway, and the equalizing plug includes a head portion having a second active surface area in fluid communication with fluid pressure in the longitudinal bore adjacent the second surface of the valve closure member, the first active surface area being greater than the second active surface area.

39. The valve closure member of claim 37, wherein:

an operating piston is disposed within the body member and moveable in response to application of hydraulic fluid and includes an operating piston surface area in communication with hydraulic fluid;

the pilot activator includes a pilot valve seat defined by a first annular sealing surface on the pilot activator and a second annular sealing surface about the pilot bore, the pilot valve seat defining a pilot surface area;

the equalizing plug includes a plug valve seat defined by a third annular sealing surface on the equalizing plug and a fourth annular sealing surface within the valve, the plug valve seat defining a plug surface area;

the pilot surface area is smaller than the operating piston surface area; and the plug surface area is greater than the operating piston surface area.

40. The valve closure member of claim 37, wherein the pilot activator includes a distal end extending from the pilot bore into the longitudinal bore above the first surface of the valve closure member when the pilot activator is in a closed position.

41. The valve closure member of claim 37, wherein the at least one equalizing passageway is disposed within the valve closure member.

42. The valve closure member of claim 41, wherein the valve closure member further includes an annular tapered surface joining the second surface of the valve closure member and the plug bore, and the at least one equalizing passageway establishes fluid communication between the first surface of the valve closure member and the tapered surface.

43. The valve closure member of claim 37, wherein the at least one equalizing passageway is an internal fluid passageway through the equalizing plug.

44. The valve closure member of claim 43, wherein the internal fluid flow passageway includes a generally longitudinal passageway extending from a second end of the equalizing plug and is in fluid communication with at least one generally radially-disposed opening exiting the plug at a location between the second end of the plug and the annular sealing surface of the plug.

45. The valve closure member of claim 37, wherein the pilot activator includes a first annular sealing surface for cooperable sealing engagement with a second annular sealing surface disposed about the pilot bore.

46. The valve closure member of claim 45, wherein at least one of the first and second annular sealing surfaces further includes a pliable annular sealing surface.

47. The equalizing subsurface valve of claim 37, wherein the equalizing plug includes a first annular sealing surface adjacent a first end thereof for cooperable sealing engagement with a second annular sealing surface formed within the valve closure member.

48. The valve closure member of claim 47, wherein at least one of the first and second annular sealing surfaces further includes a pliable annular sealing surface.

49. The valve closure member of claim 37, wherein the equalizing plug further includes an internal fluid passageway for establishing fluid communication between the longitudinal bore adjacent the second surface of the valve closure member and an annular space formed between a second surface of the pilot piston and the cylinder.

50. The valve closure member of claim 37, wherein the equalizing plug is biased within the plug bore in a normally-closed position by a spring.

51. The valve closure member of claim 37, wherein the pilot activator is biased within the pilot bore in a normally-closed position by a spring.

52. A pressure-equalizing mechanism installed within an annular housing of a subsurface safety valve, the subsurface safety valve including a body member having a longitudinal bore extending therethrough, a valve closure member movably mounted within the body member, and a sleeve member remotely shiftable within the longitudinal bore to move the valve closure member between open and closed positions to control fluid flow through the longitudinal bore, the valve closure member having a first surface and a second surface, the pressure-equalizing mechanism including:

a pilot activator movably disposed within a pilot bore in the annular housing in response to movement of the sleeve member;

a pilot piston movably disposed within a cylinder in the annular housing, a first surface of the pilot piston being in fluid communication with the pilot bore through a pilot passageway in the annular housing, the pilot activator alternately permitting and preventing fluid communication between the longitudinal bore adjacent the second surface of the valve closure member and the first surface of the pilot piston through the pilot passageway; and, an equalizing plug movably disposed within a plug bore in the annular housing in response to movement of the pilot piston, the equalizing plug alternately permitting and preventing fluid communication between the longitudinal bore adjacent the second surface of the valve closure member and the longitudinal bore adjacent the first surface of the valve closure member through at least one equalizing passageway.

53. The pressure-equalizing mechanism of claim 52, wherein:

the sleeve member includes a first recessed profile and a second recessed profile;

the pilot activator includes a distal end;

the pilot activator is in a closed position and the distal end is disposed within the first recessed profile when the valve closure member is in a fully-open position;

the pilot activator is in an open position and the distal end is disposed against an intermediate portion of the an outer surface of the sleeve member when the equalizing plug is in an equalizing position; and the pilot activator is in its closed position and the distal end is disposed within the second recessed profile when the valve closure member is in a fully-closed position.

54. The pressure-equalizing mechanism of claim 53, wherein the first recessed profile includes a first inclined surface, a first flat surface, and a second inclined surface, and the second recessed profile includes a third inclined surface, a second flat surface, and a fourth inclined surface.

55. The pressure-equalizing mechanism of claim 54, wherein:

the first inclined surface extends upwardly from the first flat surface to an outer surface of the sleeve member at an angle of approximately 45 degrees;

the second inclined surface extends downwardly from the first flat surface to the outer surface of the sleeve member at an angle of approximately 10 degrees;

the third inclined surface extends upwardly from the second flat surface to the outer surface of the sleeve member at an angle of approximately 10 degrees; and, the fourth inclined surface extends downwardly from the second flat surface to the outer surface of the sleeve member an angle of approximately 45 degrees.

56. The pressure-equalizing mechanism of claim 54, wherein the intermediate portion of the outer surface of the sleeve member intersects and is disposed between the second inclined surface of the first recessed profile and the third inclined surface of the second recessed profile.

57. The pressure-equalizing mechanism of claim 52, further including a series of baffles on an exterior surface of the annular housing and adjacent the longitudinal bore.

58. The pressure-equalizing mechanism of claim 52, wherein the first surface of the pilot piston includes a first active surface area intermittently in fluid communication with fluid pressure in the longitudinal bore adjacent the second surface of the valve closure member through the pilot passageway, and the equalizing plug includes a head portion having a second active surface area in fluid communication with fluid pressure in the longitudinal bore adjacent the second surface of the valve closure member, the first active surface area being greater than the second active surface area.

59. The pressure-equalizing mechanism of claim 52, wherein:

the subsurface safety valve further includes an operating piston disposed within the body member and remotely shiftable to move the sleeve member within the longitudinal bore;

the operating piston is a hydraulic operating piston that is moveable in response to application of hydraulic fluid and includes an operating piston surface area in communication with the hydraulic fluid;

the pilot activator includes a pilot valve seat defined by a first annular sealing surface on the pilot activator and a second annular sealing surface about the pilot bore, the pilot valve seat defining a pilot surface area;

the equalizing plug includes a plug valve seat defined by a third annular sealing surface on the equalizing plug and a fourth annular sealing surface within the valve, the plug valve seat defining a plug surface area;

the pilot surface area is smaller than the operating piston surface area; and the plug surface area is greater than the operating piston surface area.

60. The pressure-equalizing mechanism of claim 52, wherein the at least one equalizing passageway is disposed within the annular housing.

61. The pressure-equalizing mechanism of claim 52, wherein the at least one equalizing passageway is an internal fluid passageway through the equalizing plug.

62. The pressure-equalizing mechanism of claim 61, wherein the internal fluid flow passageway includes a generally longitudinal passageway extending from a second end of the equalizing plug and is in fluid communication with at least one generally radially-disposed opening exiting the plug at a location between the second end of the plug and the annular sealing surface of the plug.

63. The pressure-equalizing mechanism of claim 52, wherein the pilot activator includes a first annular sealing surface for cooperable sealing engagement with a second annular sealing surface disposed about the pilot bore.

64. The pressure-equalizing mechanism of claim 63, wherein at least one of the first and second annular sealing surfaces further includes a pliable annular sealing surface.

65. The equalizing subsurface valve of claim 52, wherein the equalizing plug includes a first annular sealing surface adjacent a first end thereof for cooperable sealing engagement with a second annular sealing surface formed within the annular housing.

66. The pressure-equalizing mechanism of claim 65, wherein at least one of the first and second annular sealing surfaces further includes a pliable annular sealing surface.

67. The pressure-equalizing mechanism of claim 52, wherein the equalizing plug is biased within the plug bore in a normally-closed position by a spring.

68. The pressure-equalizing mechanism of claim 52, wherein the pilot activator is biased within the pilot bore in a normally-closed position by a spring.

69. An equalizing subsurface valve for controlling fluid flow in a well conduit, comprising:

a body member having a longitudinal bore extending therethrough;

a valve actuator disposed for movement within the longitudinal bore;

means for controllably moving the valve actuator within the longitudinal bore;

a valve closure member mounted within the body member to control fluid flow through the longitudinal bore;

means for biasing the valve closure member to a normally-closed position to prevent fluid flow through the longitudinal bore;

means for biasing the valve actuator away from the valve closure member; and pressure equalizing means responsive to movement of the valve actuator for permitting fluid pressure above and below the valve disclosure member to equalize before the valve closure member is opened to allow fluid flow through the longitudinal bore, the pressure equalizing means including a pilot activator disposed for engagement with the valve actuator and for reciprocal movement within a pilot bore in the valve in response to movement of the valve actuator.

70. A method of equalizing pressure above and below a valve closure member in a subsurface safety valve prior to remotely shifting the valve closure member from a closed to an open position, comprising:

shifting a valve actuator within a longitudinal bore of the subsurface safety valve into contact with a pilot activator disposed for reciprocal movement within a pilot bore in the valve;

shifting the pilot activator within the pilot bore to establish fluid communication through a pilot passageway between the longitudinal bore adjacent a second surface of the valve closure member and a first surface of a pilot piston movably disposed within a cylinder in the valve; and establishing fluid communication between the second surface of the valve closure member and a first surface of the valve closure member.

* * * * *